US008646234B2

(12) United States Patent
Rutherford

(10) Patent No.: US 8,646,234 B2
(45) Date of Patent: Feb. 11, 2014

(54) LATH FURRING STRIPS

(76) Inventor: Robert B. Rutherford, Anaheim, CA (US)

( * ) Notice: Subject to any disclaimer, the term of this patent is extended or adjusted under 35 U.S.C. 154(b) by 0 days.

(21) Appl. No.: 13/455,046

(22) Filed: Apr. 24, 2012

(65) Prior Publication Data

US 2013/0255165 A1 Oct. 3, 2013

Related U.S. Application Data

(63) Continuation-in-part of application No. 13/433,247, filed on Mar. 28, 2012.

(51) Int. Cl.
*E04B 1/00* (2006.01)

(52) U.S. Cl.
USPC ..... 52/393; 52/58; 52/573.1; 52/588.1

(58) Field of Classification Search
USPC ..... 52/58, 395, 396.02, 396.04, 396.05, 52/573.1, 588.1
See application file for complete search history.

(56) References Cited

U.S. PATENT DOCUMENTS 1,357,713 A * 11/1920 Lane ..... 52/464
1,405,579 A 2/1922 Graham
3,371,456 A * 3/1968 Balzer et al. ..... 52/278
3,390,501 A * 7/1968 Driggers ..... 52/395
3,394,639 A * 7/1968 Viehmann ..... 404/47
3,722,166 A 3/1973 McNerney
3,733,767 A * 5/1973 Craik ..... 52/529
3,969,866 A * 7/1976 Kyne ..... 52/588.1
3,974,609 A * 8/1976 Attaway ..... 52/273
4,833,851 A * 5/1989 Ohmatsu ..... 52/396.05
5,078,529 A * 1/1992 Moulton ..... 403/24
5,134,825 A * 8/1992 Berridge ..... 52/520
5,357,727 A * 10/1994 Duckworth et al. ..... 52/396.06
2008/0127590 A1* 6/2008 Derrigan et al. ..... 52/395
2008/0263993 A1 10/2008 Chillson

FOREIGN PATENT DOCUMENTS

JP 2001-173203 A2 6/2001

* cited by examiner

*Primary Examiner* — Brian Glessner
*Assistant Examiner* — Adam Barlow
(74) *Attorney, Agent, or Firm* — Trojan Law Offices

(57) ABSTRACT

The present invention provides a lath furring strip having a height not exceeding 0.365 inches which has improved water-proofing capabilities by incorporating the lath furring strip into other architectural structures such as reveals, expansion joints, and window flange, coverings. By integrating these structures with a lath furring strip having water proofing features, there is increased water proofing of the entire architectural structure. One of more moisture barriers can easily be applied to the wall or furring strips that prevents seepage of moisture from the stucco on the lath to a wall or framing.

5 Claims, 14 Drawing Sheets

LATH FURRING STRIPS

CROSS-REFERENCE TO RELATED APPLICATIONS

This continuation in part application claims the benefit of patent application Ser. No. 13/433,247, filed Mar. 28, 2012.

FIELD OF THE INVENTION

This invention, relates to lath furring strips. In particular, this invention relates to a low-profile lath furring strip with improved water resistance.

BACKGROUND OF THE INVENTION

The present invention is directed to overcoming problems associated with securing a lath to a sheathing (or a wall structure). In wall construction, plaster is generally applied to a flexible lath material instead of directly attaching the lath to a rigid structure, such as sheathing, because the current means of attaching a lath directly to a rigid structure can cause cracks. By applying plaster to a metal lath (which include structures such as welded wire, woven, wire, and expanded metal lath), the plaster cracks less frequently than if compared to applying the plaster directly to the sheathing. The current method of fastening laths to sheathing is either, with staples, nails or screws. Although a moisture barrier, such as building paper, can be placed between the lath and the sheathing, the moisture barrier must be penetrated by fasteners to secure the lath. This penetration creates holes which diminish the waterproofing features of the moisture barrier. When fasteners are driven into the sheathing, not only is the moisture, barrier penetrated by the fastener, but often times the moisture barrier is torn by the lath, creating more, possible water intrusion. Screws that press metal lath tear and cut the moisture barrier as they press the metal lath into the moisture barrier and sheathing. Since plaster is water absorbent, it can transmit water to more expensive and structurally important components of the building, such as the sheathing or the framing.

Lath furring strips are one way to reduce the number of penetrations into the moisture, barrier, because the lath is attached and secured to a furring strip, and not the sheathing or framing directly. An example of a lath furring strip, is disclosed in U.S. Pat. No. 1,405,579 to Graham. This patent discloses placing a metal lath on a furring strip, which provides permanent spaces between the lath and the framing, which permits the ready application and attachment of continuous mesh reinforcements on a vertical stud. By using lath furring strips, fewer fasteners are needed to attach the furring strip, to the sheathing, thus fewer penetrations are made into the moisture barrier. Furring strips have the added function of creating an air space between the sheathing and the lath, which serves the purpose of allowing the finishing material to key better, and creates insulation.

However, there are still problems with current lath furring strips. Although the use of furring strips reduces the number of holes in the moisture barrier compared to securing the lath to moisture barrier directly, water can still seep into the sheathing and framing via the holes that were created by the furring strip fasteners. A problem with adding additional waterproofing layers to the furring strip is that any additional waterproofing on the furring strip would increase the profile height of the lath furring strip. For proper plastering of walls, the plaster thickness is commonly ⅞ of an inch, and the total height from the bottom of the furring strip cannot exceed ⅜ of an inch. However, one drawback of using a lath furring strip with a profile of less than ⅜ of an inch is that it may reduce the attachment strength on the furring strip where the lath is secured. This is due to the fact that an attachment hole, where a wire tie or clamp secures the lath to the furring strip, is situated oh the mounting leg of a lath furring strip. The mounting leg is what gives most of the height to the lath furring strip. The attachment hole cannot be too large because the larger the attachment hole, the less metal there is between the outer edge of the attachment hole and the outer edge of the mounting leg. The less metal there is on this mounting leg, the more easily the lath can break off of the furring strip due to the small amount of metal holding the tie, lath, and mounting leg together. Although one might consider reducing the side of the attachment hole on the mounting leg, it takes skill insert wire ties through a lath and attachment hole, and reducing the size of the hole to leave more metal in between the attachment hole and the edge of the mounting leg would make it much more difficult for the practitioner, to secure the lath to the mounting leg.

Therefore, there is a need for lath furring strips with properties that increase waterproofing without increasing the profile of the plaster thickness beyond ⅞ of an inch, and maintain mounting leg strength at the attachment site of the lath. Additionally, there is a need to integrally combine lath furring strips with other construction devices to simplify and to increase water proofing qualities of other construction devices that are attached to a wall or framing.

SUMMARY OF THE INVENTION

In view of the foregoing, the present invention is directed to a lath furring strip and assembly of a lath furring system on a wall that allows for better waterproofing while maintaining mounting leg strength near a lath attachment hole.

It is a purpose of the present invention to provide a low-profile lath furring strip that is more water resistant than currently available lath furring strips. The furring strip can be mounted onto the sheathing, framing or studding with a water resistive backing to reduce water seepage from the plaster to the wall, while maintaining a low height profile for proper plaster coating wall construction.

The present invention introduces such refinements. In a preferred embodiment, the invention comprises a lath furring strip that has a flexible elastic water resistive backing, such as a rubber sheet, on the bottom of the lath furring strip, which adheres or is secured to a moisture barrier such as building paper. The furring strip further comprises a mounting leg used to attach lath to furring strip. The total height from the top of the mounting leg to the bottom of the mounting plate (including all attachments to the base of the furring strip) is 0.365 inches or less. The mounting leg is hemmed such that there is additional metal between the edge of an attachment hole for a lath and the edge of the mounting leg. The fastener that attaches the wire lath to the furring strip can be a wire clip, a C ring, a wire tie, or other means to fasten a lath to a furring strip. The lath furring strip can also be incorporated into termination points, channel screeds, drips screeds and weep screeds to increase waterproofing material between a wall and plaster.

The rubber sheet can be fixed to the lath furring strip and has an adhesive coating, which may have a peelable layer, to temporarily secure the mounting plate on the furring strip to a solid barrier. A mounting device, such as a nail or screw, is inserted through the lath furring strip, to secure the furring strip to the sheathing or framing, and penetrates the moisture barrier. The furring strip may have pre-cut holes for mounting, or may have no mounting holes in its prefabrication embodiment, whereby the mounting holes are created with self-tapping screws or other mounting devices. The rubber backing on the furring strip aids in waterproofing because when the nail or screw that secures the furring strip to the sheathing applies pressure to the rubber backing, the rubber backing is squeezed such that it at least partially fills in any gaps that would normally allow water to seep through the mounting hole and building paper to the other side of the lath furring strip. This prevents water from seeping through any holes that were in the building paper and damaging more expensive structures such as sheathing, framing, or studding.

Incorporating a thick rubber sheet to the bottom of a lath furring strip increases waterproofing, but if a rubber sheet is too thick, such as 1/32, 1/16 or 1/8 of an inch, it would significantly raise the lath furring strip. This presents a problem because, the thicker the rubber sheet, the greater the height of the furring strip mounting leg. Preferably, the attachment hole is 5/16 of an inch for ease of a practitioner inserting an attachment device such as a wire tie. As the height of the lath furring strip increases with added layers such as, rubber strips, the mounting legs must decrease, to keep the overall height of the lath furring strip at or below 0.365 inches since, the entire plastering thickness cannot exceed 7/8 of an inch. The lath furring strip can preferably be made from steel or other metals such as Galvanized steel or stainless steel.

In one embodiment of the present invention, the lath furring strip can be of different shapes, such as a shape that ills an inside corner, or a shape that fits an outside corner. The lath furring strip that fits an inside corner comprises two sides that mount against the solid barrier, such as sheathing, framing, wail, studding, or moisture barrier. Extending from each mounting plate is a mounting leg that is bent inward relative to the mounting plates of the lath furring strip. The lath is attached via attachment holes on the mounting legs. In the embodiment, where the lath furring strip fits an outside corner, the furring strip has two plates that mount against the solid barrier or moisture barrier on sheathing. Extending from each mounting plate is a mounting leg that is bent outward relative to the mounting plates of the lath furring strip. The height of the furring strip from the base of the furring strip or the moisture barrier to the tip of the mounting leg, where the lath is attached, cannot exceed 0.365 inches. In the corner lath furring strip embodiments, the furring strip comprises a flexible elastic, water resistant barrier, a first mounting plate for mounting said furring strip onto a solid barrier, a second mounting plate adjacent to, and substantially perpendicular to the first mounting plate, a mounting leg extending substantially perpendicular from the first mounting plate, a second mounting leg adjacent to, and substantially perpendicular to the second mounting plate, a first attachment hole for attaching lath to the furring strip to the first mounting leg, and a second attachment hole for attaching the lath to the second mounting leg. The first mounting plate is substantially parallel to the second mounting leg. The second mounting plate is substantially parallel to said first mounting leg. The first mounting plate is substantially perpendicular to said first mounting leg. The second mounting plate is substantially perpendicular to said second mounting leg. The mounting legs can either be bent inward (for use as an inside corner lath furring strip) or outward (for use as an outside corner lath furring strip) with respect to the mounting plates of the lath furring strip.

In another embodiment of the present invention, the lath furring strip can have a mounting leg of different shapes. By bending or curving the mounting leg, the height of the overall lath furring strip (including all flexible elastic water resistive barriers) can still remain at of under 0.365 inches. The advantage, of a bent leg is that more metal can be between the attachment hole where the lath attaches to the lath furring strip, and the lengthwise edge of the mounting leg. In one embodiment with a bent mounting leg, the mounting leg can have a hairpin loop such, that the leg is hemmed. In another embodiment of a bent mounting leg, the mounting leg can be bent such that the mounting leg has an additional extension leg that protrudes perpendicularly form the mounting leg. Preferably, the mounting leg and the extended part of the mounting leg are each equal, to or less than 0.365 inches, and does not increase the total profile height of the lath furring strip to greater than 0.365 inches. Preferably, the size of the attachment hole for the lath is 5/16 of an inch. When a rubber backing is added to these furring strips, it raises the height of the furring strip. Since the height, of the furring strip cannot exceed 0.365 inches, the height of the mounting leg must be reduced. Reducing the height of the mounting leg by bending the mounting leg in various configurations solves the problem increasing the amount of metal between the edge of the attachment hole and the edge of the mounting leg.

In another, embodiment of the present invention, the flexible elastic water resistive barrier fits within a recessed area around the mounting hole, or if the mounting hole is not pre-punched, in an area that will become the mounting hole. This recessed area may be a continuous recessed area that runs substantially along the length of the furring strip, or the recessed area may be localized to just around where the mounting hole is or will be. The flexible elastic water resistive barrier can be a rubber gasket that is a long strip, which runs, across a continuous recessed groove on the furring strip, or the flexible elastic water resistive barrier can be a small rubber gasket that fits within a punched-out area localized to the mounting hole area. The punched-out area can be circular or another shape where the gasket fits snugly within the recessed punched-out cavity. The gasket can have a pre-punched hole for a nail or screw to enter, or can be solid, and a hole will be made when a nail or screw pierces the gasket when it attached to the solid barrier. The advantage of a flexible elastic water resistive barrier, in the recessed groove or cavity is that when these gaskets are squeezed due to the pressure caused by a nail or screw securing the lath furring to the sheathing or framing, the rubber fills in spaces in the mounting hole where water might have seeped into or out of, had there been no gasket. Preferably, the lath furring strip can have attachment holes on the mounting leg to attach the lath to the furring strip, as previously described. The mounting legs can have the same hemmed mounting legs as previously described to increase the strength of the mounting leg near the attachment holes.

In another embodiment of the present invention, the lath furring strips in the previously, mentioned embodiments can be assembled with the lath and attached to sheathing and framing with termination points such as channel screeds or termination stops to form a lath and furring attachment system. The lath furring strip can be of the shape of any of the aspects previously mentioned aspects, and can have the flexible elastic water resistive barrier of any of the previously mentioned embodiments. In one embodiment, the lath and furring attachment system is comprised of a furring, a lath, and attachment device for securing the lath to the furring strip, a moisture barrier such as building paper, and another attachment device for securing the furring strip to a solid barrier such as sheathing or framing. The attachment device to attach the lath to the furring can be a tie (such as a wire tie, preferably 18 gauge), a clip, or C ring. A C ring may have the advantage of reducing the height profile of the assembled lath and furring system because wire ties have extensions that may protrude up through the plaster, while a C rings do not.

To apply plaster, an important aspect is the termination point. An effective method of achieving this termination is through a termination stop such as J-Moulding or Milcor, which is commonly used, around windows or doors. J-Moulding provides a clean transition from stucco to an alternative surface. A channel screed can also be used in a lath furring system which creates a recessed reveal that offers an architectural accent while providing a control joint to help minimize cracking. A moisture barrier such as building paper can be placed in between the J-Moulding termination stop of channel screed and the sheathing. When termination points are added, this allows water to migrate through the furring system when installed at termination points above doors and windows. Preferably, in one embodiment, the moisture barrier can be layered such it lays on top of the termination stop but behind the furring strip. The channel screed or termination stop can also have the previously mentioned embodiments of the flexible elastic water resistive barrier incorporated into it. The termination stop and channel screed can be attached to the solid barrier via attachment devices such as screws or nails. The height of the furring strip from the tip of the mounting leg to the bottom of the furring strip used in this embodiment still is a maximum of 0.365 inches. Lath is attached to the furring strip via attachment wholes on the mounting leg. The lath furring strips of this embodiment can be of any of the shape, and can have the waterproofing embodiments waterproofing embodiments previously described, or other embodiment with a flexible elastic water resistant barrier and bent mounting leg on a lath furring strip.

In another embodiment of the invention, a lath mounting device for mounting to a wall is comprised of a mounting leg, a first mounting plate and a second mounting plate. The first mounting plate has a front side and back side. The first mounting leg is formed at a substantially right angle to the front side of the first mounting plate and has at least one hole formed in the mounting leg for attaching lath. The second mounting plate is connected to the first mounting plate in a manner to permit the second mounting plate to be substantially parallel to the back side of the first mounting plate, the second mounting plate has a length greater than the first, mounting plate. The second mounting plate has a terminal end that includes an angled leg that crosses the plane of the first mounting plate. The lath mounting device provides a unitary structure that creates two layers of plates to inhibit water penetration to the wall and also provides an angled leg formed with the device to channel water away at the bottom of the wall.

In another embodiment, the terminal end of the second, mounting plate that includes an angled leg that, crosses the plane of the first mounting plate creates weep screed that will prevent water from wicking up into the exterior plaster walls and also will allow water that may get into the walls to migrate out. This type of furring strip allows water to drip from the plaster on the outside of a wall by a window to drip down and away from the wall from an extension leg from the drip screed, which is part of the lath furring strip. The weep screed has a longitudinal backing which is a second mounting plate that lies against a wall or sheathing, which is adjacent to the first mounting plate of the furring strip, forming a double layer of protection made from the furring strip material. A moisture, barrier, such as building paper, adds, another layer of protection by lying over the lath furring strip drip screed and over the mounting device, such as a screw, which secures the lath furring strip weep screed to the wall or sheathing. This moisture barrier adheres though ah adhesive to the mounting plate of the lath furring strip such that water cannot seep up the furring strip to the holes creating by the mounting device such as a screw. The maximum height from the backing of the lath furring strip weep screed mounting plate to the top of the mounting leg, which attaches the lath, is 0.365 inches, and to reduce the height of this mounting leg, embodiments, such as the ones previously described, may be employed.

In another, embodiment, the terminal end of the second mounting plate that includes an angled leg that crosses the plane of the first mounting plate creates a drip screed that will prevent water from wicking up into the exterior plaster walls and also will allow water that may get into the walls to migrate out. This type of furring strip allows water to drip from the plaster on the outside of a wall by a window to drip down and away from the wall from an extension leg from the drip screed which is part of the lath furring strip. The drip screed has a longitudinal backing that lies against a wall or sheathing, which is adjacent to the first mounting plate, of the furring strip, forming a double layer of protection made from the furring, strip material. A moisture barrier, such as building paper, adds another layer of protection by lying over the lath furring strip drip screed and over the mounting device, such as a screw, which secures die lath furring strip drip screed to the wall or sheathing. This moisture barrier adheres though an adhesive to the first mounting plate of the lath furring strip such that water cannot seep up the furring strip to the holes creating by the mounting device, such as a screw. The maximum height from the backing of the lath furring strip drip screed mounting plate to the top of the mounting leg, which attaches the lath, is 0.365 inches, and to reduce the height of this mounting leg, embodiments, such as the ones previously described, may be employed.

In another embodiment, the terminal end of the second mounting plate that includes an angled leg that crosses the plane of the first mounting plate. The angled leg is substantially at a 90 degree angle from the second mounting plate and extends beyond the mounting leg. This angled leg has an additional bend that is substantially parallel to both the first and second mounting plates, which creates a termination stop. The two mounting plates provide an additional layer of furring material between the lath and the wall or sheathing. A screw, nail, or other mounting device secures the lath furring strip termination stop to the wall. Preferably, a moisture barrier, such as building paper is placed on top of the first mounting plate of the furring strip closest to the lath, and covers the mounting device such that water cannot enter the a hole created by the mounting device into the wall or sheathing. The moisture barrier preferably has an adhesive that secures the moisture barrier to the top of first mounting plate nearest the mounting leg to prevent any water from the lath to get in between the moisture barrier and the hole created by the mounting device. The maximum height from the back of the second mounting plate to the top of the mounting leg, which attaches the lath, is 0.365 inches, and to reduce the height of this mounting leg, embodiments that reduce the height of the mounting leg, such as the ones previously described, may be employed. The termination stop furring strip preferably has a total profile height of ⅞ of an inch from the mounting plate against the wall to the end of the termination stop leg.

In another embodiment of the invention, the lath furring strip is integral with a decorative metal trim, commonly referred to as a "reveal" that is used in construction of structures that will have a plaster exterior finish. Architects may specify that at various points on a wall that a reveal should be incorporated with lath furring strip to change the aesthetics of the plaster finish. In this unique embodiment, the lath furring strip will preferably incorporate lath furring at a consistent three eights of an inch and may provide openings every three and one quarter-inches on the lath mounting leg for the wire tie method of lath attachment. The lath furring strip is installed to the wall or framing by fasteners, such as self-tapping screws, that secure mounting plates to a wall or framing covered by a moisture barrier, such as waterproof building paper. This embodiment has bottom mounting plates on each side of the reveal. The bottom side of the mounting plates attach to the wall or framing and form a bottom mounting plane against the wall. On top of each bottom mounting plate is a parallel top mounting plate, connected through a bend between the top and bottom mounting plates, forming a dual layer mounting plate on each side of the reveal. The reveal can preferably have triangular shaped protrusions, extending beyond the plane formed by the attached lath. Between the two triangular shaped protrusions is a recessed region that acts as part of the decorative trim. The embodiment may further have the flexible elastic water resistive backing on the furring strip to prevent moisture from seeping through holes created by the fastening device previously described, which can preferably be 1/32, 1/16, or 1/8 of an inch. This embodiment can also have the hemmed mounting legs to increase the amount of metal between the attachment holes on the mounting leg and the edge of the mounting leg to increase the stability of the structure between the attachment hole and the mounting leg edge. The lath furring strip has mounting legs with holes such that lath can be attached to this embodiment via a wire tie or other attachment device. The height of the lath furring strip from the bottom mounting planes of the furring strip to the top of the mounting legs is preferably 0.365 inches or less so that the lath can be at a consistent 3/8 of an inch from the wall or framing.

In still a further embodiment of the lath furring strip reveal, a moisture barrier can preferably be installed over the fasteners, and over the top mounting plates. This process will eliminate all of the penetrations in the moisture barrier secured by the lath. This process will eliminate the need for additional layers of moisture barriers that would be required around, other types of decorative metal trim.

In another embodiment, the lath furring strip, is a two-piece expansion joint used in construction of structures that will have a plaster finish on the exterior. Since construction codes call for plaster-finished exteriors to have expansion, joints at specific intervals, this embodiment allows for the expansion and contraction of materials due to temperature changes. In this unique embodiment each expansion joint is integral with a lath furring strip. This embodiment has two separate pieces, each piece can secure lath via an attachment device such as a wire tie, through holes on mounting legs. Each of the expansion joints can be secured to a wall or framing through via mounting devices such as screws, self-tapping screws, or nails. The two-piece expansion joint can be installed to provide a variable size to the expansion joint width depending on the width the architect would specify in the plans. In the first expansion joint, there are a is a bottom mounting plate and a top mounting plate, forming a dual layer mounting plate where the plates are substantially parallel to each other. The bottom side of the mounting plates attach to the wall or framing and form a bottom mounting plane against the wall. The dual layer mounting plates can be secured to a wall or framing by the use of a screw or nail. Extending substantially perpendicular from the top mounting plate is a mounting leg, which has holes for securing lath to the first expansion joint. The bottom mounting plate extends past the mounting leg to a distance, such that the second expansion joint can overlap the first expansion joint. As the bottom mounting plate extends past the mounting leg, it bends to form a horizontal termination leg, which is parallel to the bottom mounting plate, forming a dual layered bottom mounting plate and horizontal termination leg. Extending substantially perpendicular from the horizontal termination leg is a vertical termination leg, extending preferably seven eights of an inch. Extending substantially perpendicular from the vertical termination leg is a termination flange.

A second expansion joint can be placed over the first expansion joint such that the horizontal termination leg of the second expansion joint is on top of the horizontal-termination leg of the first expansion joint. The second expansion joint is able to sit flush with the first expansion joint because the second horizontal termination leg is raised compared to the horizontal termination leg on the first expansion joint. This raised horizontal termination, leg is achieved through a flared region on the bottom mounting plate on the second expansion joint. The bottom side of the mounting plate attaches to the wall or framing and form a bottom mounting plane against the wall. The flare extends away from the plane of the wall when the furring strip secured, creating a space for the first expansion joint to fit under the second expansion joint. This design is unique in that it provides a pre-tensioned bend in the metal to allow for a tight seal when the expansion joints are secured to a wall or framing with a lath furring strip. This greatly improves moisture intrusion protection. Parallel and on top of the bottom mounting plate on the second expansion joint is a top mounting plate formed by a bend between the top and bottom mounting plates. Extending substantially perpendicular from the top mounting plate is a mounting leg for attaching lath. The second expansion joint is secured to a wall or framing via a mounting device such as a screw, self-tapping screw, or nail. Preferably, between the wall and the two-piece expansion joint is a moisture barrier. Preferably, a water barrier will be installed over the fasteners that secure the expansion joints to the wall to eliminate all of the penetrations in the moisture barrier around the expansion joints. Preferably, the distance from the bottom mounting planes to the top of each mounting leg that secures the lath through attachment holes is 0.365 inches or less so that lath can be incorporated a consistent 3/8 of an inch from the wall or framing. This embodiment may further have the flexible elastic water resistive backing on the expansion joints, which can preferably be 1/32, 1/16, or 1/8 of an inch, to prevent moisture from seeping through holes created, by the fastening device previously described. This embodiment may also have the hemmed mounting legs to increase the amount of metal between the attachment holes on the mounting legs and the edge of the mounting leg to increase the stability of the structure between the attachment holes and the mounting leg edges.

In another embodiment of the invention, a lath furring strip is incorporated with a window furring strip. This embodiment is for use around windows constructed with plaster depth grounds incorporated in the window design from the manufacturer. The furring strip has a bottom mounting plate which is parallel and integral with a top mounting plate, formed by a bend between the two mounting plates. Extending substantially perpendicular is a mounting leg for securing lath to the mounting leg via a hole on the mounting leg. Preferably, the distance from the plane formed by the bottom of the bottom mounting plate and the top of the mounting leg is not greater than 0.365 inches so that lath can be secured at a uniform 3/8 of an inch from the wall or framing. This embodiment is unique in that it designed to have a pre-tensioned shape in the metal or the strip to allow the embodiment to seal tightly against the window flange and also has a water resistant lath furring strip, which prevents water from penetrating the wall or framing. Preferably, a moisture barrier is placed on top of the top mounting plate and on top of the fastening device, which eliminates any moisture barrier penetration around the window and the need for additional water barrier product, such as Biuthane or rubber to be layered into the window flashing. Extending from the bottom mounting plate is a flared region that angles away form the plane of the bottom mounting plate. Extending from this flared region is a flashing plate. The combination of the flare and the flashing plate creates a space such that the flashing plate can lay on top of the window flange. When the furring strip is secured to the wall or framing, the flashing plate of the furring strip is pressed against the window flashing, creating a more waterproof barrier between the two. Preferably, the bottom mounting plate can have a flexible elastic barrier to improve water resistance, which can preferably be 1/32, 1/16, or 1/8 of an inch, and can prevent water from seeping from the plaster into the wall or framing. Preferably, a moisture barrier may be placed on top the top mounting plate such that any hold created by the screw or other mounting device the secured the furring strip to the wall is covered. Preferably, the mounting leg can be a hemmed mounting leg such that more metal is between any attachment hole on the mounting leg and the edge of the mounting leg.

BRIEF DESCRIPTION OF THE DRAWINGS

The above and various other objects and advantages of the invention will be described and understood from the following description of the preferred embodiments of the invention, the same being illustrated in the accompanying drawing.

DETAILED DESCRIPTION OF THE INVENTION

Figure 7:
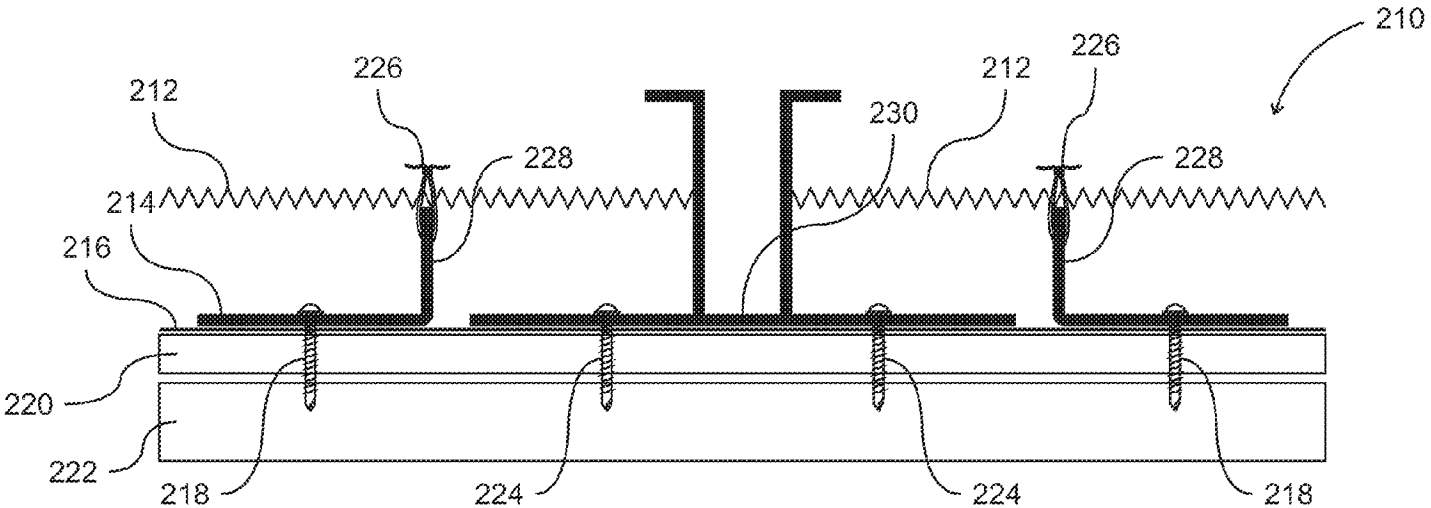
FIG. 7 is a side elevation view of an assembled lath and lath furring strip mounted to a sheathing and framing.
Figure 8:
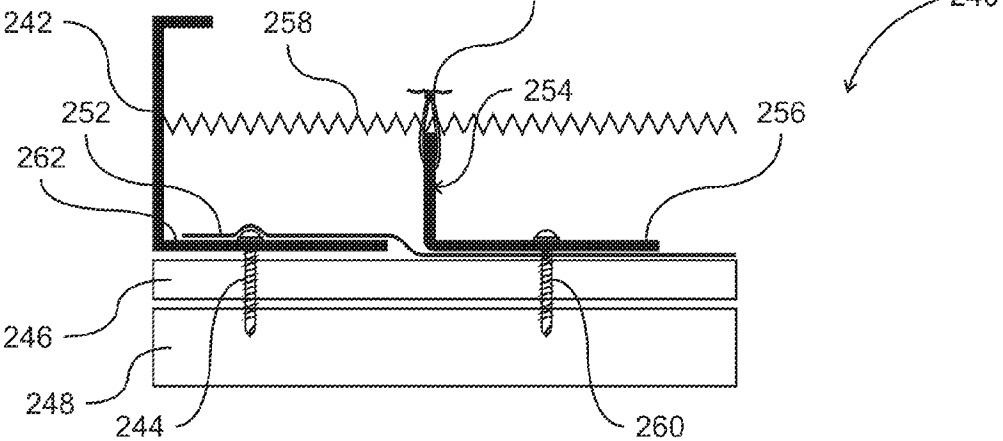
FIG. 8 is a side elevation view of an assembled lath and lath furring strip mounted to a sheathing and framing with overlapping waterproof paper.

The following description is of the best-contemplated mode of carrying out the invention. This description is made for the purpose of illustrating the general principles of the invention and should not be taken in a limiting sense. The scope of the invention is best determined by reference to the appended claims. Preferable embodiments of the present invention are described with reference to the FIGS. 1-14. FIG. 1, FIG. 5, and FIG. 6 show various embodiments of increasing the waterproofing characteristics of the lath furring strip. FIG. 2, FIG. 3, and FIG. 4 show various embodiments of the shape of the lath furring strip without any waterproofing elements, but can incorporate the waterproofing elements of the embodiments in any other figure. FIG. 7 and FIG. 8 show various embodiments of how the lath furring strip and lath are assembled, and may incorporate any of the waterproofing or lath shapes in any of other figures. FIG. 9, FIG. 10, FIG. 11, FIG. 12, FIG. 13, and FIG. 14 show various embodiments of integrating a lath furring strip with termination stops, screeds, such as weep screed and drip screed, window furring, reveal, trims, and two-piece expansion joints. These embodiments can be combined with other embodiments described below.

Figure 1B:
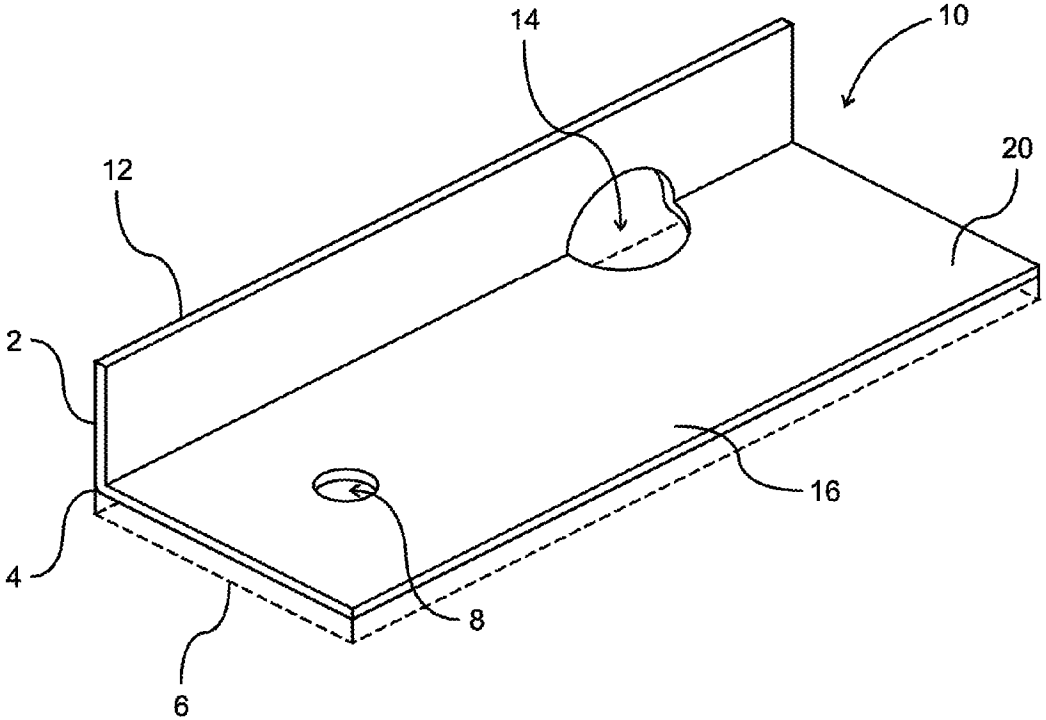
FIG. 1*b* is a perspective view of a lath furring strip having a rubber backing.
Figure 1A:
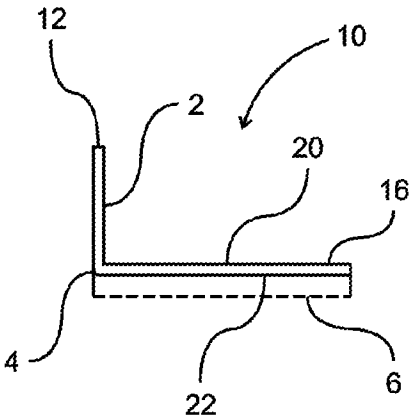
FIG. 1*a* is a side elevation view of a lath furring strip with a rubber backing, and a single mounting leg.

FIG. 1*a* and FIG. 1*b* depict a lath furring strip 10 which has a mounting plate 20 and a mounting leg 2, which is substantially perpendicular to the mounting plate 20. On the bottom 22 of the mounting plate 20 is a flexible elastic water resistive barrier 6 such as a rubber sheet, fixed to the bottom side 22 of the furring strip 10. The height of the lath furring strip 10 from the bottom of the flexible elastic resistive barrier 6 to the top of the mounting leg 12 does not exceed 0.365 inches. The mounting side 20 has a top side 16 and a bottom side 22. A mounting hole 8 traverses the mounting plate 20 and goes through the top side 16 to the bottom side 22. A nail or screw can be inserted into the mounting hole 8 to secure the lath furring strip 10 to the solid barrier, such as sheathing, framing, studding, or wall, and may attach to a solid barrier through an intermediary moisture barrier, such as a building paper. The mounting hole can also be created by the use of self tapping screws. The mounting leg 2, where the lath is attached, may attach attaches via a clip, wire tie, C ring, or other means of securing a lath to the attachment hole 14. The attachment hole may span both the mounting plate 20 and mounting leg 2. The mounting leg 2 is integral with lath furring strip 10 and created by a bend 4 that forms a substantially perpendicular mounting leg 2 relative to the mounting plate 20. The flexible elastic water resistive barrier 6 may have an, adhesive coating on the bottom of the flexible/elastic water resistive barrier 6 such that the furring strip 10 can adhere to a solid barrier or moisture barrier.

Figure 2B:
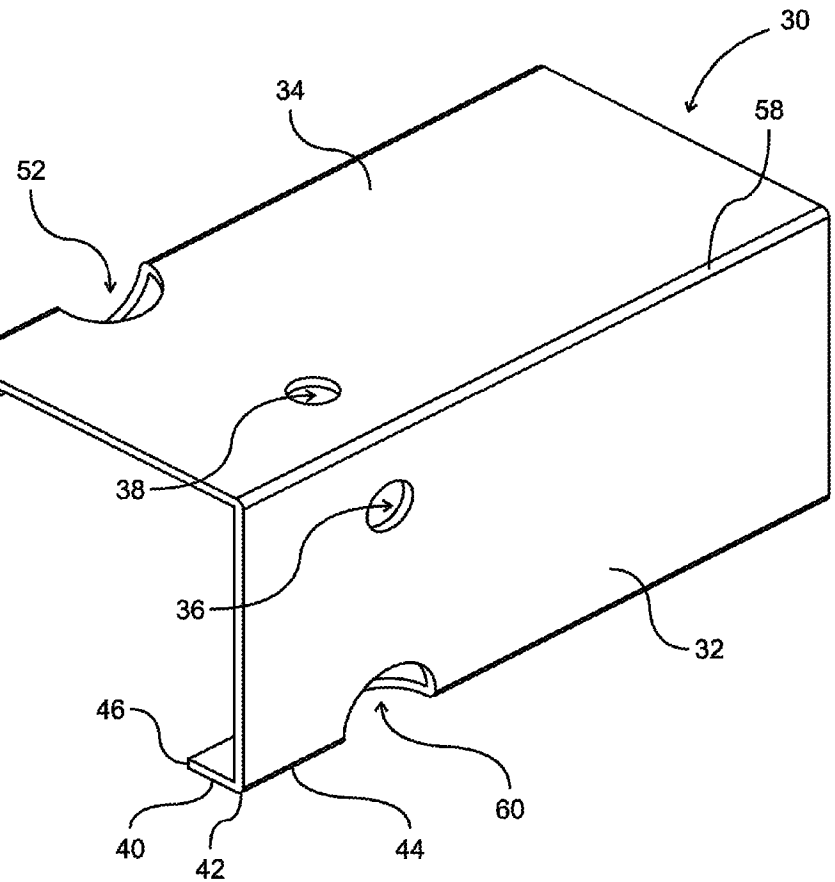
FIG. 2*b* is a perspective view of an outside corner lath furring strip.
Figure 2A:
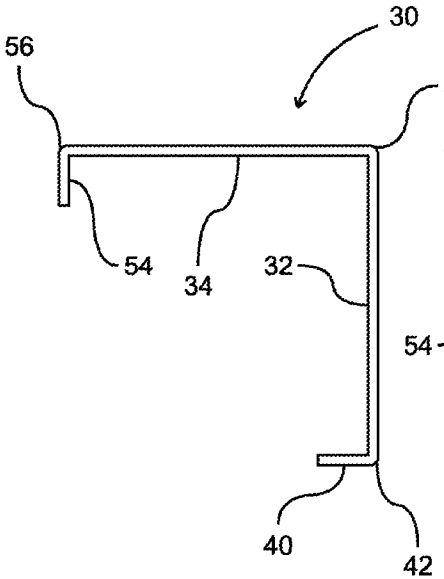
FIG. 2*a* is a side elevation view an inside corner lath furring strip having a rubber-backing.

FIG. 2*a* and FIG. 2*b* show two views of an example of a furring strip 30 used for an inside corner of a wall. A first side 32 of the furring strip 30 has a mounting hole 36. A screw or nail can be used to secure the first mounting plate 32 to a solid barrier such as a wall, sheathing, or framing, which has corner, and may attach to the solid barrier through an intermediary moisture barrier, such as building paper. A second mounting plate 34 of the furring strip 30 also has a second mounting hole 38 and is secured to a solid barrier. The corner 58 of the furring strip 30 nestles into the corner of the structure which the furring strip 30 attaches to. The furring strip 30 has a first mounting leg 40 and a second mounting leg 54, which are each equal or less than 0.365 inches from the top of the mounting leg 46 to the bottom of the first mounting plate 32 or second mounting plate 34 of furring strip 30. An attachment hole 60 on the first mounting plate 32 and an attachment hole 52 on the second mounting plate are used to attach a lath to the furring strip via a wire tie, clip or C ring. The attachment hole 60 may span both the first mounting plate 32 and the first mounting leg 40 through the corner 44 of the first mounting plate 32 and first mounting leg 40. Similarly, the attachment hole 52 on the second mounting plate 34 may span the corner 56 of the second mounting plate 34 to the second mounting leg 54. In a cross sectional view of the furring strip 30, the furring strip 30 forms an open square-like structure as shown in FIG. 2*a*, where the first mounting plate 32 and the second mounting plate 34 are two sides of the open square, with the corner 58 between these two mounting plates 32, 34. The first mounting side 32 and the first mounting leg 40 are at substantially a right angle to each other, and meet via a corner 42. The second mounting plate 34 and second mounting leg 54 are substantially at a right angle to each other and meet via a corner 56. A lath can take the cornering shape of the furring strip 30 by attaching a lath that is perpendicular to the mounting legs 40, 54, and parallel to the two mounting plates 32, 34 via attachment devices that connect the lath to the attachment holes 52, 60. The furring strip 30 can have a flexible elastic waterproof barrier as shown in FIG. 1, FIG. 5. FIG. 6, or other type of flexible elastic water resistive barrier.

Figures 3A, 3B:
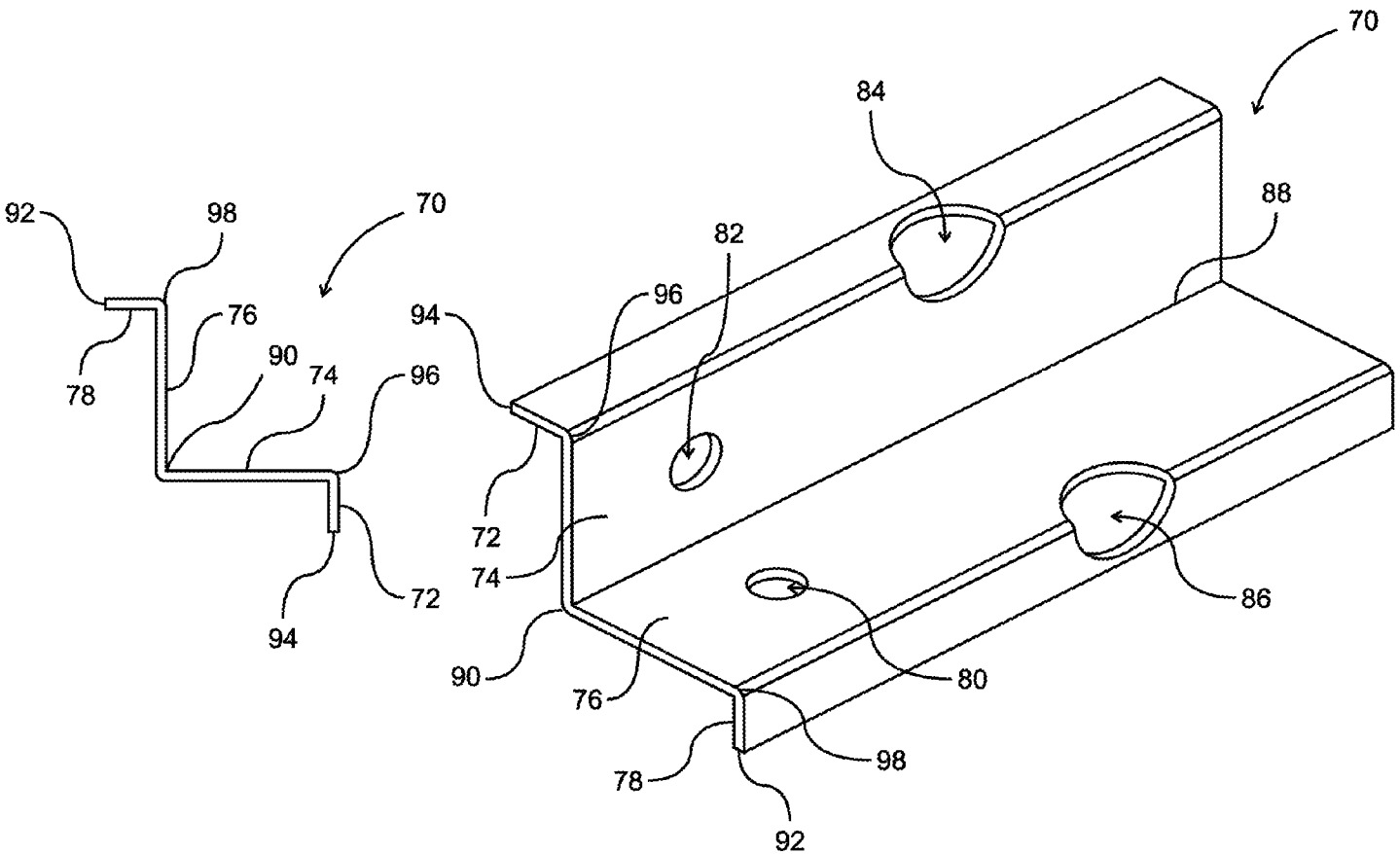
FIG. 3*a* is a side elevation view of outside corner lath furring strip.
FIG. 3*b* is a perspective view of an outside corner lath furring strip.

FIG. 3*a* and FIG. 3*b* show two views of an example of a furring strip 70 meant for use on an outside corner of a wall. A first mounting plate 76 of the furring strip 70 has-a mounting hole 80 where a screw or nail can be inserted and secures the furring strip 70 to a solid barrier such as a sheathing, framing, or wall. A mounting hole 82 on a second mounting plate 74 secures the furring strip 70 to a solid barrier on an outside corner. The corner 88 of the furring strip 70 nestles in the corner of a wall for attachment. Extending from the first mounting plate 74 and the second mounting plate 76 are a first mounting leg 78 and a second mounting leg 72 respectively. The first mounting leg 78 is substantially perpendicular to the first mounting plate 76 and meet at a corner 98. The second mounting leg 72 is substantially perpendicular to the second mounting, plate 74 and meet at a corner 96. The height of furring strip 70 from the tip 92 of the first mounting leg 78 to the base of the first mounting plate 76 is equal to or less than 0.365 inches. Likewise, height from the the tip 94 of the second mounting leg 72 to the base of the second mounting plate 74 is also equal to or less than 0.365 inches. An attachment hole 86 secures a lath to the furring strip 70, and this attachment hole 86 may span both the first mounting side 76 and first mounting leg 78. Another attachment hole 84 secures a lath the furring strip 70, and this attachment hole 84 may span both the second mounting plate 74 and second mounting leg 72. The first and second, mounting plates 74, 76 can have the flexible elastic waterproof barriers as depicted in FIG. 1, FIG. 5, FIG. 6, or other embodiments of a flexible elastic waterproof barrier.

Figure 4B:
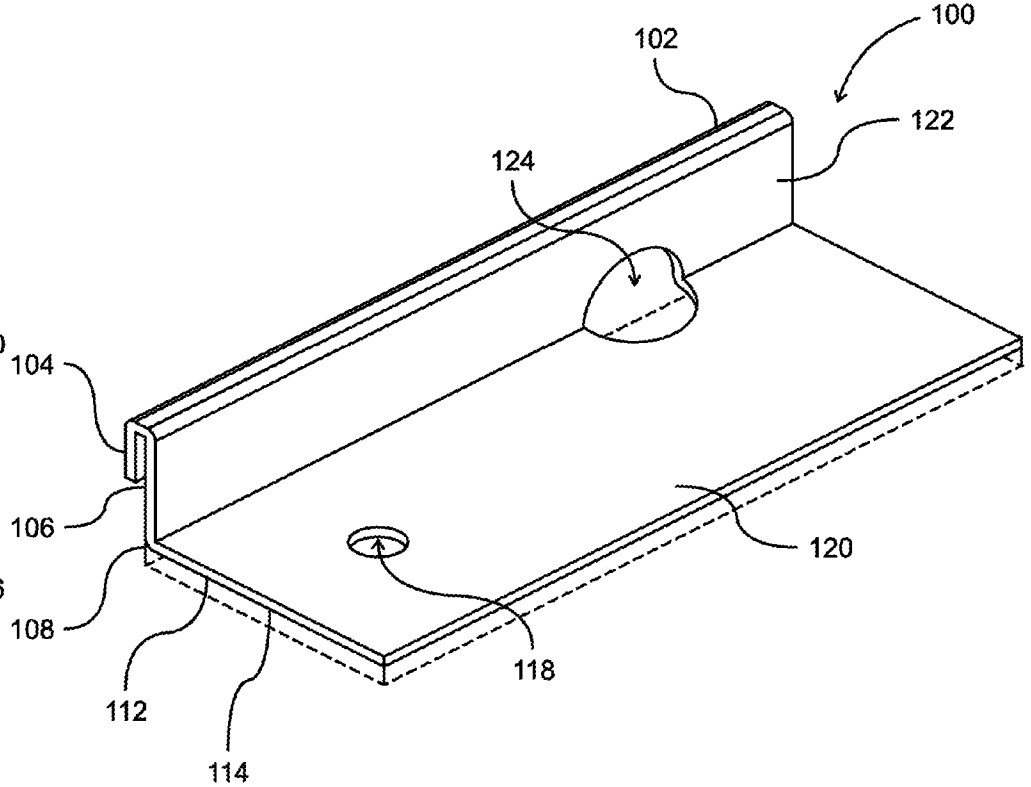
FIG. 4*b* is a perspective view of a lath furring strip having a hemmed mounting leg.
Figure 4A:
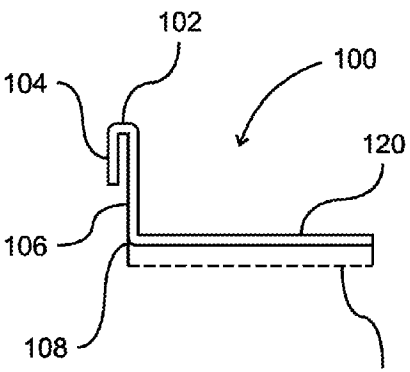
FIG. 4*a* is a side elevation view of a lath furring strip having a hemmed mounting leg.

FIG. 4*a* and FIG. 4*b* are two views of another embodiment of a furring strip 100. In this embodiment, the mounting leg 122 is hemmed, such that it is bent on an edge 102. The height from the bottom 114 of the furring strip 100 to the top of the bent edge 102 is no greater than 0.365 inches. This bend forms a hairpin loop 104 with an opening 106, which increases the amount of total furring strip material from the attachment hole 124 to the edge of the mounting leg 122. The furring strip 100 has a mounting hole 188 within the mounting plate 120. A screw, nail, or other attachment device secures the furring strip 100 to a solid barrier, such as sheathing, framing, or wall. On top of this solid barrier there may be a moisture barrier such as building paper. The mounting plate 120 can have a flexible elastic water resistive barrier 116 on the bottom 114 of the mounting plate 120, or can have flexible elastic water resistive barriers of other embodiments as depicted in FIG. 1, FIG. 5, FIG. 6, or other embodiments. The feature of a hemmed mounting leg 122 in FIG. 4*b*, increases the strength of the mounting leg 122 because of additional furring strip material between the attachment hole 124 and the edge of the mounting leg 122. The furring strip 100 has an attachment hole 124 for attaching a lath to the furring strip 100.

Figure 4D:
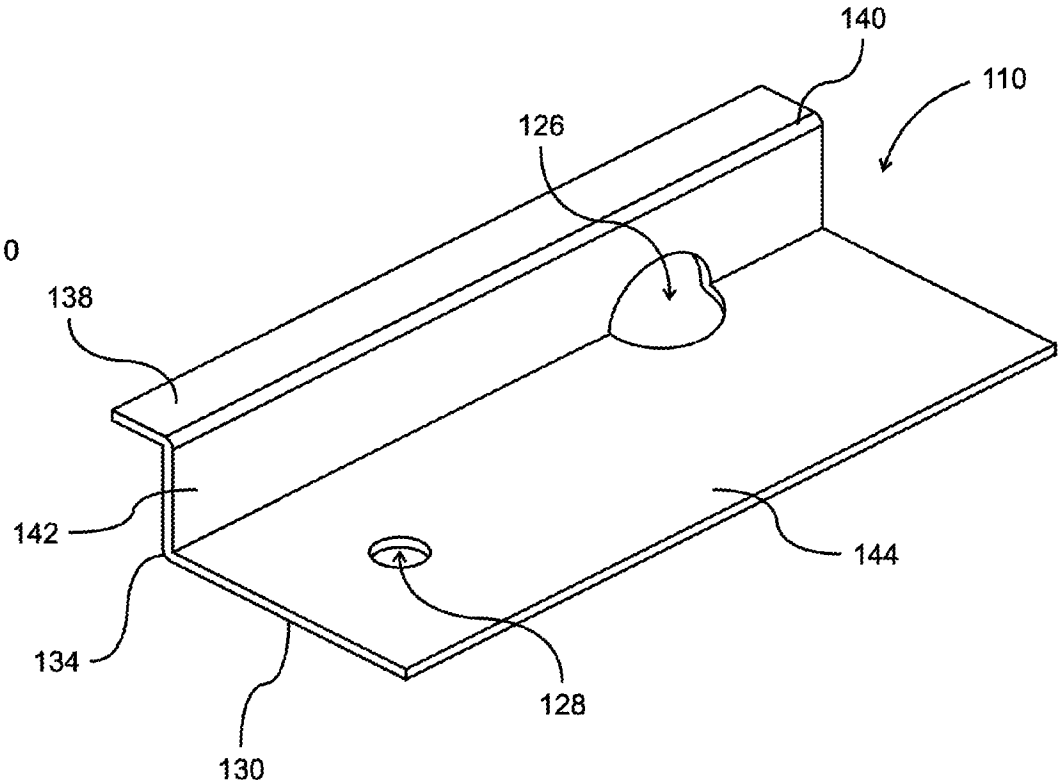
FIG. 4*d* is a perspective view of a lath furring strip having a bent mounting leg.
Figure 4C:
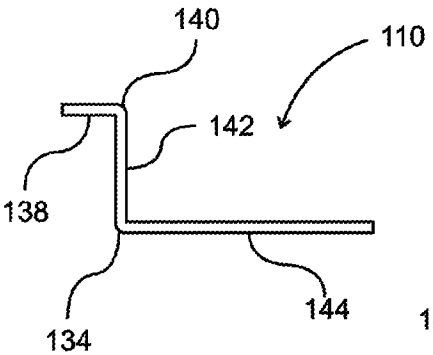
FIG. 4*c* is a side elevation view of a lath furring strip having a bent mounting leg.

FIG. 4*c* and FIG. 4*d* depict another embodiment of a furring strip 110 that increases the total amount of furring strip 110 material (such as steel or stainless steel) that is on the mounting leg 142. The mounting leg 142 can be bent perpendicularly to make an edge 140, such that the extension leg 138 of the mounting leg 142 is no longer than 0.365 inches, and the mounting leg 142 with the attachment hole 126 is also no longer than 0.365 inches. The attachment hole 126 may span the mounting plate 144 through a corner 134 that is formed between the mounting leg 142 and the mounting plate 144. The total height from bottom 130 of the mounting plate 144 to the top of the extension leg 138 is no greater than 0.365 inches. The furring strip 110 may incorporate various embodiments of a flexible elastic water resistive barrier such as the embodiments depicted in FIG. 1, FIG. 5, FIG. 6 or other embodiment of a flexible elastic waterproof barrier on a furring strip.

Figures 5A, 5B:
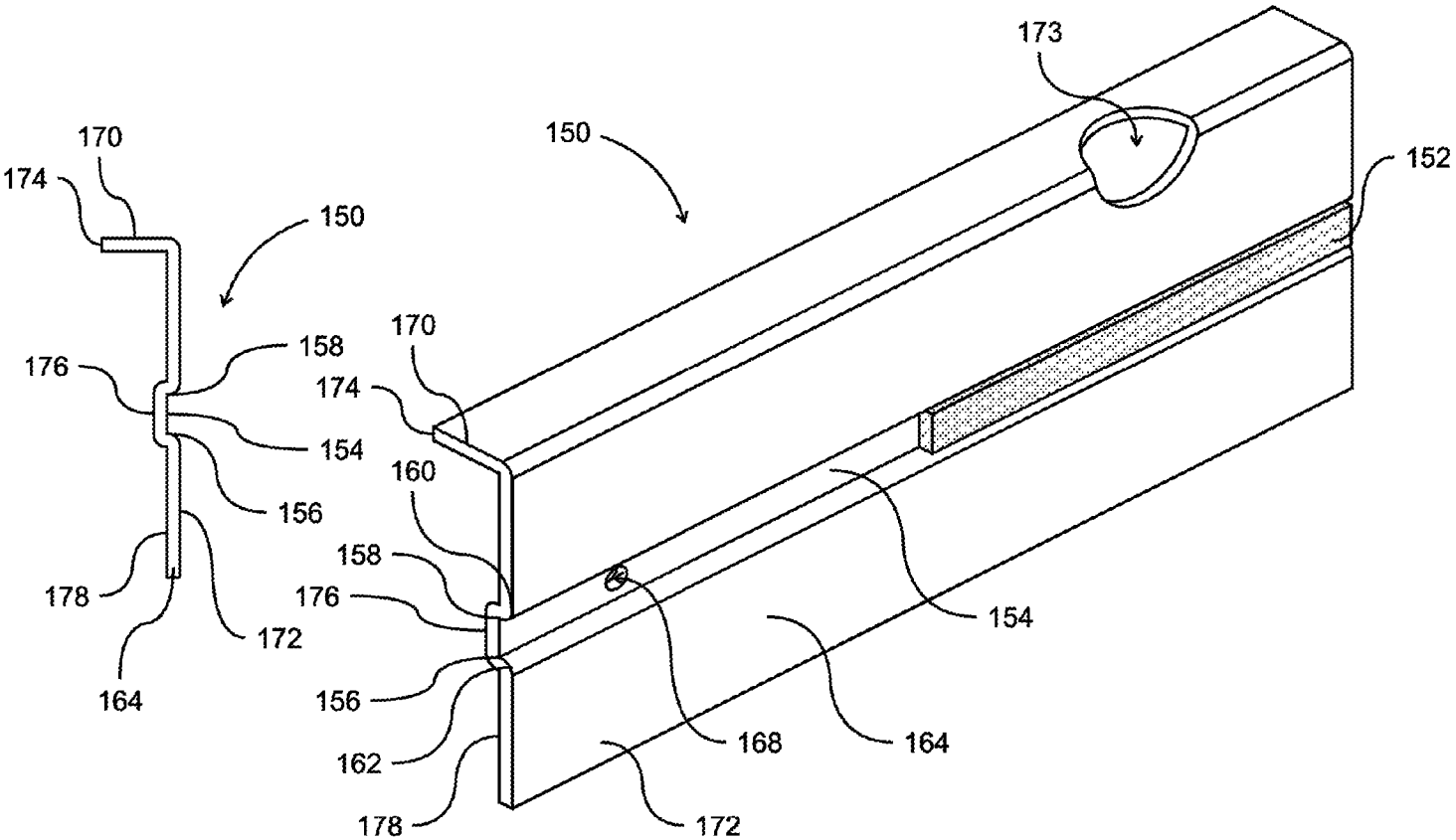
FIG. 5*a* is a side elevation view of a lath furring strip having a continuous recess for a rubber gasket.
FIG. 5*b* is a perspective view of a lath furring strip having a continuous recess for a rubber gasket.

FIG. 5*a* and FIG. 5*b* illustrate two views of a furring strip 150 with a recessed groove 154 for a rubber gasket 152. The recessed groove 154 allows flexible elastic water resistive barrier, such as a rubber gasket 152 to line a mounting hole 168 without increasing the overall height of the furring strip 150, such that the distance from the bottom side 172 of the mounting plate 164 to the tip 174 of the mounting leg 170 does not exceed 0.365 inches. The recessed groove 154 can be within the bottom side 172 of mounting plate 164 of the furring strip 150. The top surface 178 of the mounting plate 164, which has a mounting hole 168 can be raised but to provide a thickness of the recessed area of the furring strip 150 material equal to the thickness of the furring strip 150 material through the rest of the mounting plate 164. The recessed groove 154 can be implemented in other designs of furring strips, such as the ones illustrated in FIG. 2, FIG. 3, or FIG. 4. The recessed groove 154 can have a variety of shapes that enable it to fit a rubber gasket 152. A first side 156 of the recessed groove 154 can be angled towards a mounting hole 168, forming an obtuse angle from the bottom side 172 of the furring strip 150 towards the mounting hole 168, and a second side 158 of the recessed groove 154, which is closer to the mounting leg 170 also forms an obtuse angle from the bottom side 172 of the mounting plate 164 towards the mounting hole 168. The top surface of the recessed groove 154 can be flat with no angles such that it fits a rubber gasket 152 with a flat top side. The recessed groove 154 can also be of other shapes that fit differently shaped gaskets.

In another embodiment, the recessed groove can be angled from the bottom side 172 of the mounting plate 164 such that a first side of the flare 160 closest to the mounting leg 170, and the recessed groove closest to the non-raised portion 162 of the furring strip 150, both recess in a perpendicular fashion in relation to the bottom side 172 of the mounting plate 164 before being angled in toward each other. A nail or screw attaches the furring strip 150 to a solid barrier such as a sheathing, wall, or framing by securing the furring strip 150 through via the mounting device through the mounting hole 168. The furring strip 150 also has an attachment hole 173 to secure the lath to the furring strip 150.

Figure 6C:
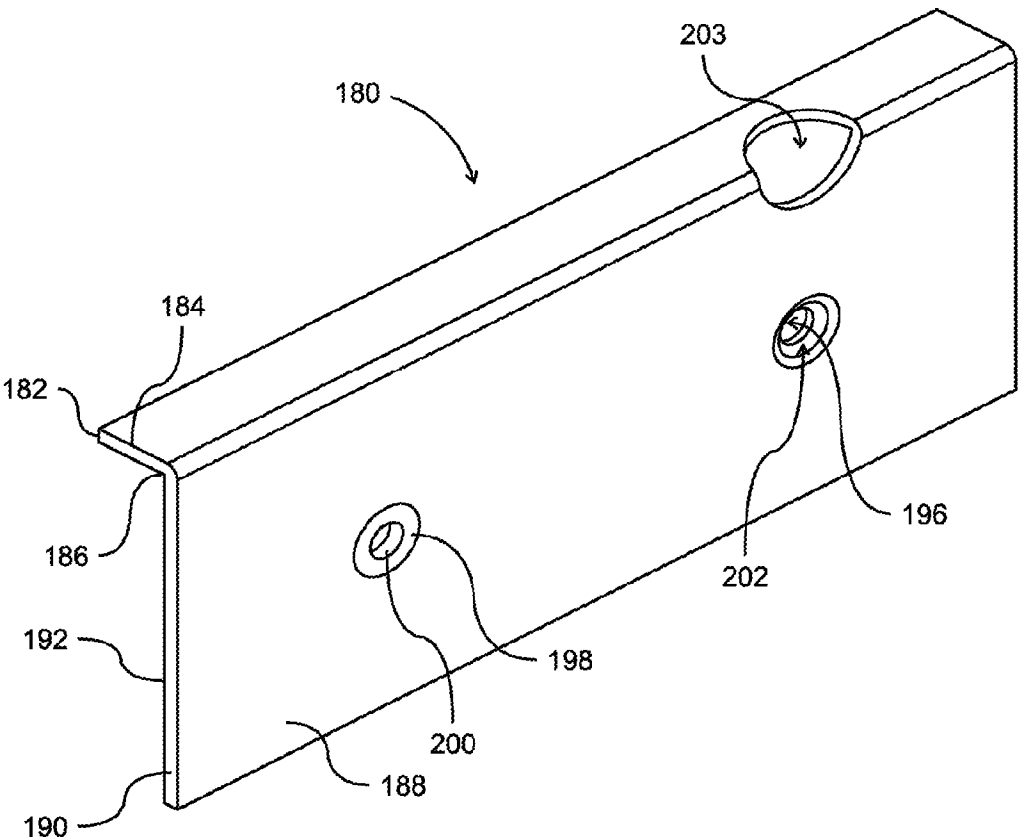
FIG. 6*c* is a perspective view of a lath furring strip having punched holes with rubber gasket inserts.
Figure 6A:
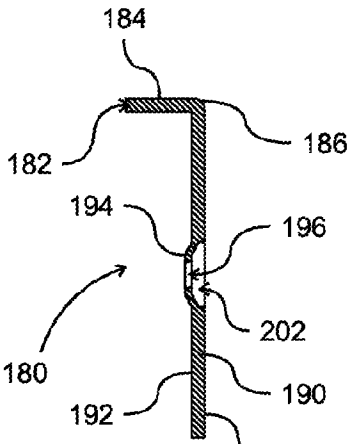
FIG. 6*a* is a sectional view of a lath furring strip having punched holes with rubber gasket inserts.
Figure 6B:
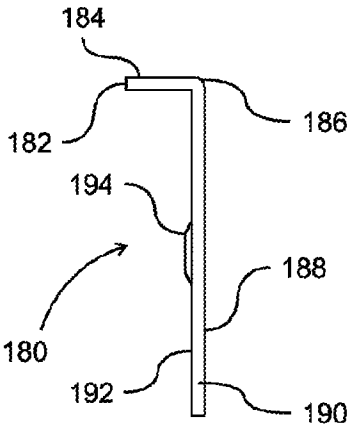
FIG. 6*b* is a side elevation view of a lath furring strip having punched holes with rubber gasket inserts.

FIG. 6*a*, FIG. 6*b*, and FIG. 6*c* illustrate three views of a furring strip 180 with punched holes 196 for a rubber gasket 198. This feature enables the furring strip 180 to have an flexible elastic water resistive barrier nestled within the furring strip 180, but does not add any height to the furring strip 180, such that the height from the tip 182 of the mounting leg 184 to the bottom of the bottom of the mounting plate 188 does not exceed 0.365 inches. The furring strip 180 is secured to a solid barrier such as sheathing, framing, or a wall via a screw or nail that goes through the mounting hole 196 and rubber gasket 198. The rubber gasket 198 can have a hole 200 within it, such that the nail or screw can pass through the mounting side 190 more easily. The top of the mounting plate 192 can have a raised region 194 on top of the recessed cavity 202 which contains the mounting hole 196, such that the thickness of mounting plate 190 around the recessed cavity 202 is equal to the thickness of mounting plate 190 in the raised regions. The mounting leg 184 is substantially perpendicular to the mounting plate 190 and meet at a corner 186. The rubber gasket 198 can have circular shape, or other shape that can fit sit inside the recessed cavity 202. The furring strip 180 has an attachment hole 203 to secure a lath to the furring may be on the mounting leg 184. The recessed cavity 202 embodiments can be utilized in other furring shapes, such as the ones depicted, in FIG. 1, FIG. 2, FIG. 3, and FIG. 4.

FIG. 7 shows an illustration of a lath furring strip system 210 attached to a wall, which is comprised of sheathing 220 and framing 222. The lath furring strip 214 is secured to the sheathing 220 and framing 222 via a screw 218. In this embodiment, there is a channel screed 230 also secured, to the sheathing 220 and framing 222, via two screws 224. A metal lath 212 is attached to the mounting leg 228 via a wire tie 226. Between the furring strip 214 and the sheathing 220 is a moisture barrier 216, such as building paper. This barrier runs the entire length under the furring strip 214 and channel screed 230. The screws 218, 224 pierce the moisture barrier 216. The furring strip 214 can have the flexible elastic water resistive barrier embodiments of FIG. 1, FIG. 5, and FIG. 6 to protect water from seeping from the pierced moisture barrier 216 to the sheathing 220 and framing 222. By securing the furring strip 214 with the screw 218 or other mounting device, the flexible elastic water resistive barrier squeezes into a shape where it fills in gaps in a mounting and prevents, water from seeping to the sheathing 220 or framing 222. In this embodiment of a lath and lath furring strip system, 210 a channel screed 230 creates a recessed reveal which offers an architectural accent while providing a control joint to help minimize cracking.

FIG. 8 is an illustration of a lath and lath furring strip system 240 where a furring strip 256 is secured to sheathing 246 and framing 248 via a mounting screw 260. This embodiment also has a termination stop called a J-channel stop 242, such as Milcor, which provides for better water drainage. A lath 258 is attached to a mounting leg 254 of the furring strip 256. The termination stop 242 is attached to the sheathing 246 and framing 248 via a mounting screw 244. A moisture barrier 252 sits on the top side 242 of a termination stop 242. The moisture barrier 252 is also situated between the lath furring strip 256 and the sheathing 246 and is penetrated by the screw 260 of the lath furring strip 256. To prevent moisture from passing from the lath furring strip system 240 into the sheathing 246 or framing 248, the bottom of the lath furring strip 256 can have a flexible elastic water resistive barrier, such as the ones described in the embodiments of FIG. 1, FIG. 5, and FIG. 6.

Figure 9A:
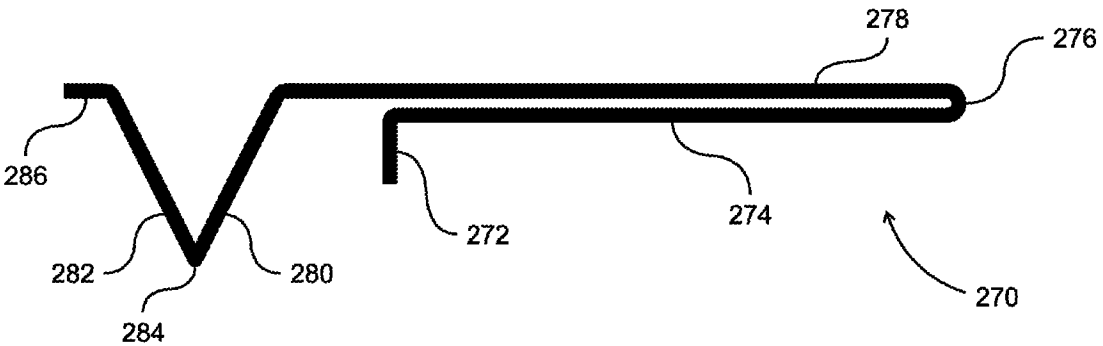
FIG. 9*a* is a side elevation view of a furring strip integrated with a weep screed.
Figure 9B:
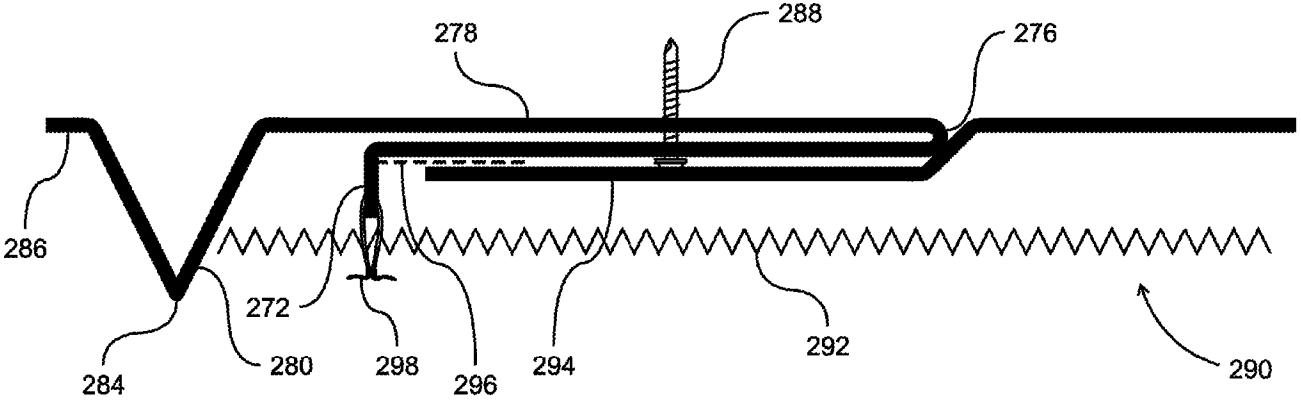
FIG. 9*b* is a side elevation view of a furring strip integrated with a weep screed, and with an assembled lath and mounting screw.

FIG. 9*a* and FIG. 9*b* depict embodiments, of an integrated lath furring strip weep screed 270, and a lath furring strip weep screed 270 with an assembled lath and mounting device 290. The lath furring strip weep screed 270 has a mounting leg 272 that has a profile height from the bottom of a second mounting plate 278 to the top of the mounting leg 272 of 0.365 inches or less. The mounting leg 272 has an attachment hole for attaching a lath 292 to the mounting leg 272 via an attachment device such as a wire tie 298. The mounting leg 272 is substantially at a right angle to a first mounting plate 274. A hairpin loop 276 bends the furring strip material substantially 180 degrees such that there is an extra layer of furring strip 270 material creating a second mounting plate 278 behind die first mounting plate 274. A screw 288 or other mounting device secures the lath furring strip weep screed 270 into a wall or sheathing through both the first mounting plate 274 and second mounting plate 278. A moisture barrier 294, such as building paper, is placed between the lath and the furring strip mounting side 274, which covers a hole created by the screw 288 or other mounting device, which secures the lath furring strip weep screed 270 to the wall. A moisture barrier 294 adheres to the top side of the first mounting plate 274, which covers the screw 288 and top side of the first mounting plate 274 through an adhesive layer 296 which prevents water from seeping in between the lath 292 and the top side of the first mounting plate 274. The second mounting plate 278 extends past the mounting leg 272 and angles toward the lath 292 and forms a first weep leg 280. The first weep leg 280 is bent back at a point 284 to form a second weep screed leg 282 which also is angled to form a side 286 that sits flush with the wall. This allows, water to drip from the plaster on the lath 292 away from the wall.

Figure 10A:
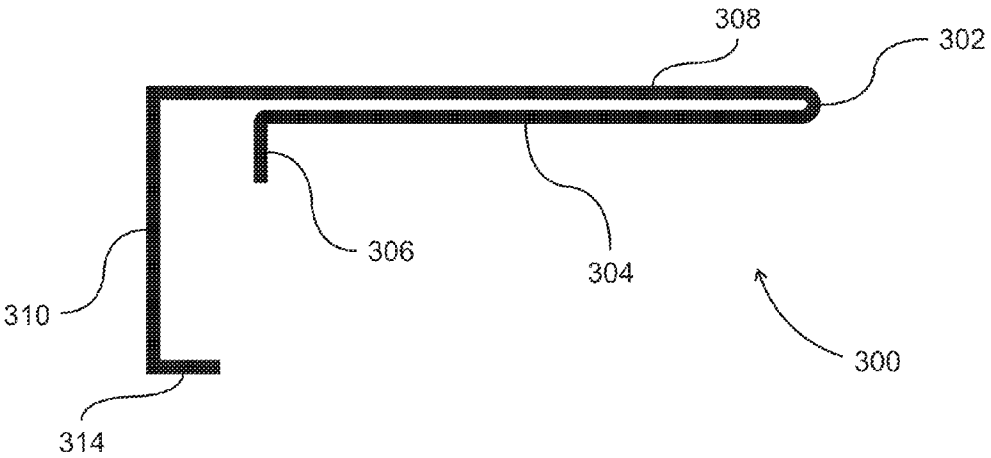
FIG. 10*a* is a side elevation view furring strip integrated with a termination stop.
Figure 10B:
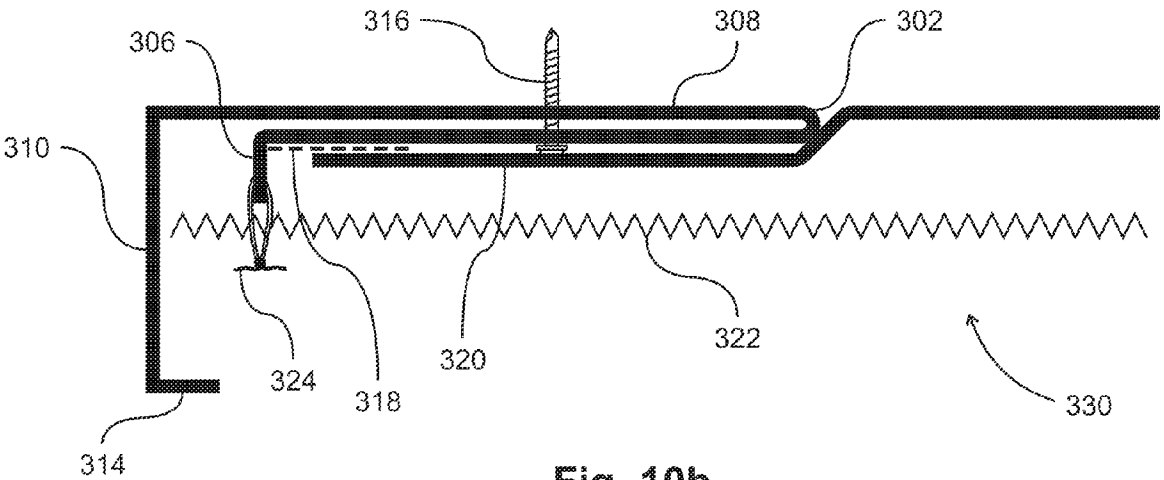
FIG. 10*b* is a side elevation view of a furring strip integrated with a termination stop and assembled lath and mounting screw.

FIG. 10*a* and FIG. 10*b* depict embodiments of an integrated lath furring strip termination stop 300, and a lath furring strip termination stop assembly 330 with a mounting device 316 and lath 322. The lath furring strip termination stop 300 has a mounting leg 306 that has a profile height from the bottom of the second mounting plate 308 to the top of the mounting leg 306 of 0.365 inches or less. The mounting leg 306 has an attachment hole for attaching a lath 322 to the mounting leg 306 via an attachment device such as a wire tie 324. The mounting leg 306 is substantially at a right angle to a first mounting plate 304. A hairpin loop 302 bends the furring strip material substantially 180 degrees such that there is an extra layer of furring strip material which make the first mounting plate 304 and the second mounting, plate 308 parallel to each other. A screw 316 or other mounting device secures the lath furring strip termination stop 300 into a wall or sheathing through both the furring strip mounting side 304 and termination stop mounting side 308. A moisture barrier 320 adheres to the top side of the first mounting plate 304, which covers the screw 288 and top side of the first mounting plate 304 through an adhesive layer 318 which prevents water from seeping in between the lath 322 and the top side of the first mounting plate 304. The second mounting plate 278 extends past the mounting leg 272 and turns at substantially a right angle angles toward the lath 322 and forms a termination stop leg 310. The termination stop leg 310 is bent at substantially a 90 degree angle to become parallel to the second mounting plate 308. This allows water to drip from the plaster on the lath 292 away from the wall. This termination stop structure is used where the plastering of a wall ends and other material begins, and prevents water from seeping into a wall.

Figure 11A:
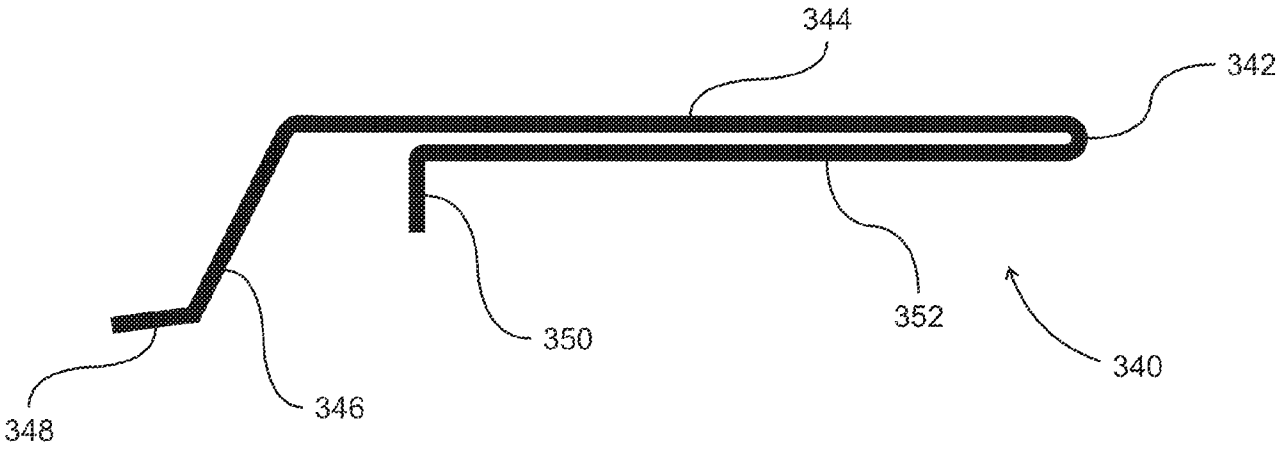
FIG. 11*a* is a side elevation view of a furring strip integrated with a drip screed.
Figure 11B:
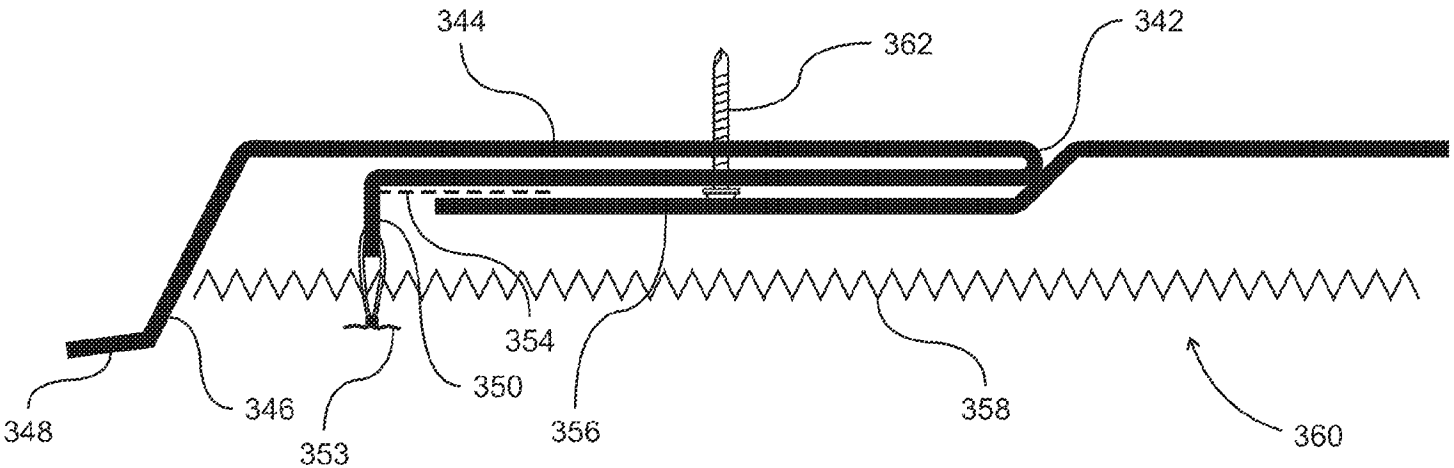
FIG. 11*b* is a side elevation view of a furring strip integrated with a drip screed and assembled lath and mounting screw.

FIG. 11*a* and FIG. 11*b* depict embodiments of an integrated lath furring strip with a drip screed 340, and a lath furring strip drip screed assembly 360 with a mounting device 362 and lath 358. The lath furring strip drip screed 340 has a mounting leg 350 that has a profile height from the bottom of the second mounting plate 344 to the top of the mounting leg 350 of 0.365 inches or less. The mounting leg 350 has an attachment hole for attaching a lath 358 to the mounting leg 350 via an attachment device such as a wire tie 353. The mounting leg 350 is substantially at a right angle to first mounting plate 352. A hairpin loop 342 bends the furring strip material substantially 180 degrees such that there is an extra layer of furring strip material creating the second mounting plate 344 behind the first mounting plate 352. A screw 362 or other mounting device secures the lath furring strip drip screed 340 into a wall or sheathing through both the first mounting plate 352 and second mounting plate 344. A moisture barrier 356, such as building paper, is placed between the lath 358 and the first mounting plate 352, which covers a hole created by the screw 362 or other mounting device which secures the lath furring strip 340 to the wall. The moisture barrier 356 adheres to the first mounting plate 352 by having an adhesive layer 354. The second mounting plate 344 extends past the mounting leg 350 and angles toward the lath 358 and away from a wall, such that any water would fall down the drip screed leg 346 or off of an extension of that leg 348 away from the wall or window.

Figure 12A:
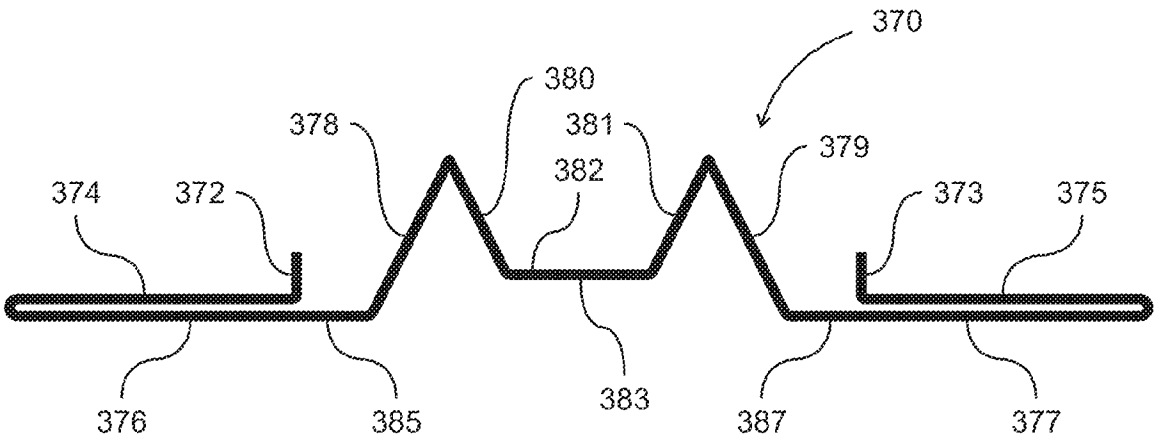
FIG. 12*a* is a side elevation view of a reveal furring strip.
Figure 12B:
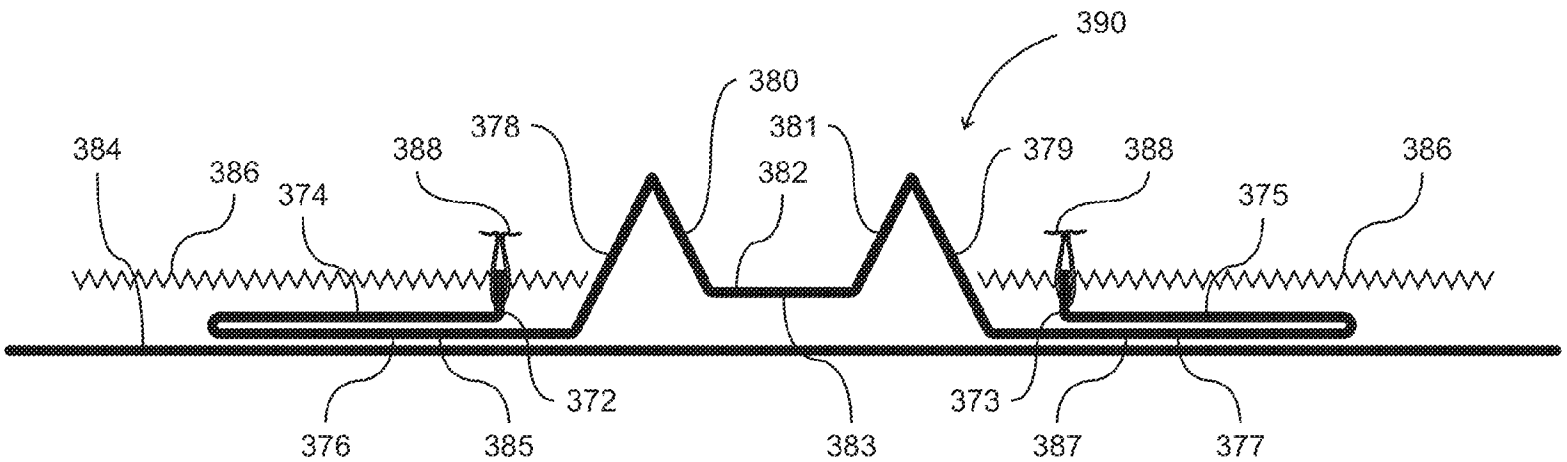
FIG. 12*b* is a side elevation view of a reveal furring strip assembled with a lath and moisture barrier.

FIG. 12*a* and FIG. 12*b* depict an embodiment of a lath furring strip with a reveal 370 and an assembled lath furring strip with a reveal 390. The assembled lath furring strip with a reveal includes an attached lath 386 and a moisture barrier 384. The embodiment of the lath furring strip with a reveal 370 and assembled lath furring strip with a reveal 390 is integrated with decorative metal trim. It is this decorative metal trim which is commonly referred to as a reveal 383. The lath furring strip with a reveal 370, 390, has two inner side protrusions 380, 318 and two outer protrusions 378, 379 which form two triangular-like shapes that form the reveal 383 and two furring strip sections 385, 387 on each side of the reveal 383. The outer protrusions 378, 379 extend and form an obtuse angle with bottom mounting plates 376, 377 (forming bottom mounting planes at the base of the bottom mounting plates 376, 377) that may be placed against a wall framing that has a moisture barrier 384. The bottom mounting plates 376, 377 are bent into second mounting plates 374, 375 on top of the bottom mounting plates 376, 377. Extending perpendicular from the top mounting plates 374, 375 are mounting legs 372, 373 which has attachment holes for securing lath 386 by way of a wire tie 388 or other mechanism that can attach lath 386 to a furring strip 370, 390. The height of the furring strip with a reveal 370, 390 from the base of the furring strip 370, 390 to the top of the mounting leg 388 is 0.365 inches or less so that the lath 386 can be consistently laid at ⅜ of an inch away from the framing. The furring strip with a reveal 370, 390 is secured to the framing by fasteners that penetrate both the first mounting plate 376, second mounting plate 374, and moisture barrier 384. The bottom mounting plates 376, 377 are pressed against the moisture barrier 384 when secured to the framing via the screw or other mounting device. This pressure prevents moisture from seeping in from the plaster to through holes in the moisture 384. The lath furring strip with a reveal 370, 390 can have the added strength of a hemmed mounting leg 122 as shown in FIG. 4*b*. Additionally, other embodiments featuring a furring strip with a reveal 370, 390 can have the flexible water resistive barrier 6 as shown in FIG. 1*a* or 166 in FIG. 4*b*, to further prevent seepage of water from plaster through holes created through the moisture, barrier 384 by nails or screws that penetrate the moistures barrier 384 that hold the lath furring strip with a reveal 370, 390 in place.

Figure 13A:
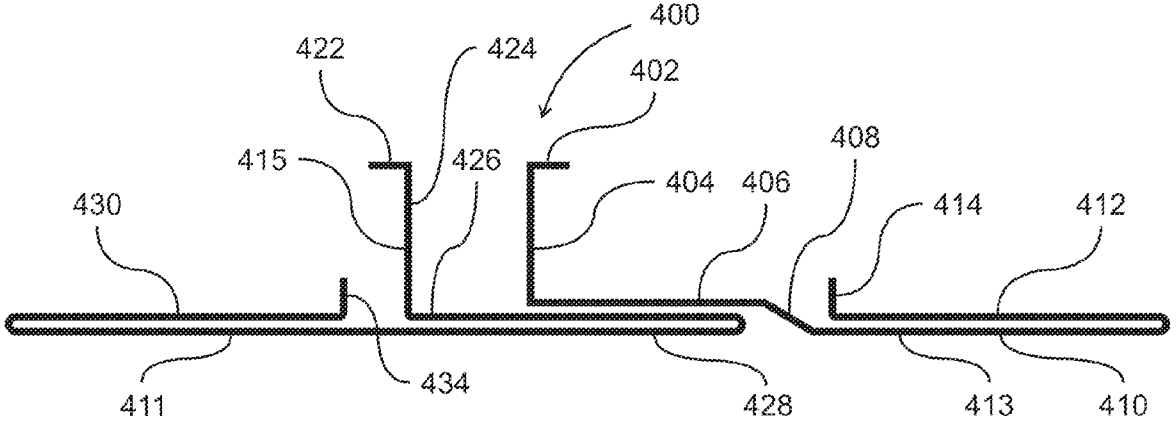
FIG. 13*a* is a side elevation view of a two-piece expansion joint furring strip.
Figure 13B:
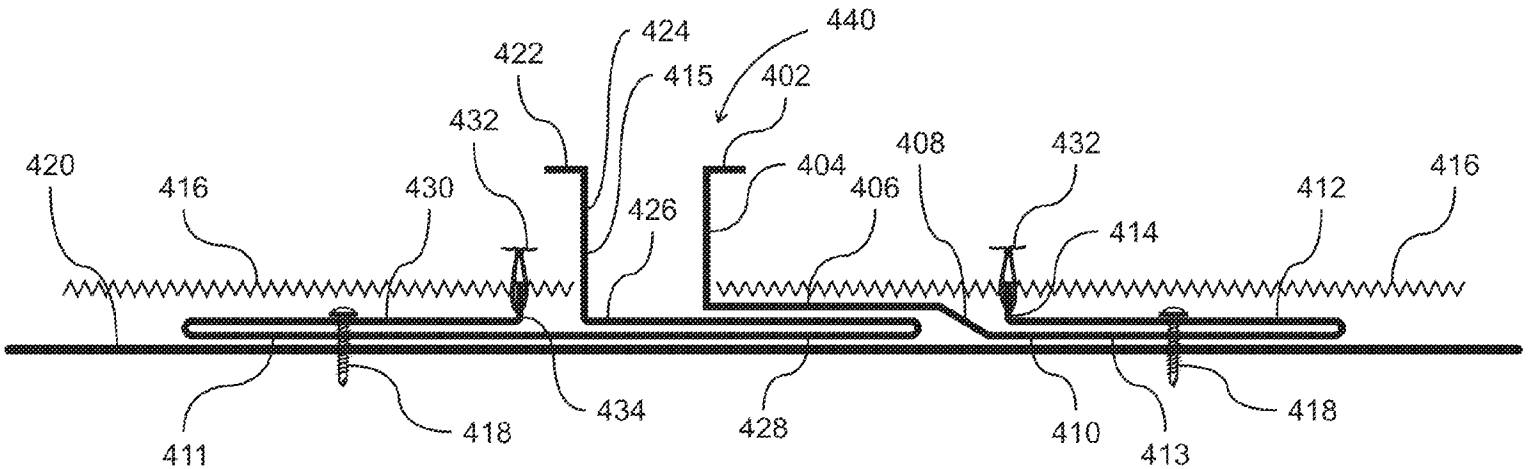
FIG. 13*b* is a side elevation view of a two-piece expansion joint furring strip assembled with a lath and moisture barrier.

FIG. 13*a* and FIG. 13*b* depict a two-piece expansion joint 400 and an assembled two-piece expansion joint 440 with lath 416, wire ties 432, screws 418, and moisture barrier 420. Construction codes call for plaster-finished exteriors to have expansion joints at specific intervals allowing for the expansion and contraction of materials that occur during temperature changes throughout the day. In a first piece 411, there is a bottom mounting plate 428 and a top mounting plate 430. The top mounting plate 430 has a mounting leg 434 for attaching lath 416 to the mounting leg 434 with a wire tie 432 or other means for attachment. The top mounting plate 430 is substantially parallel to the bottom mounting plate 428. The bottom mounting plate 428, which at its base forms a bottom mounting plane, extends past the mounting leg 434. The bottom mounting plate 428 is bent to then form an integral first overlapping plate 426 on top of the first mounting plate 428. Extending perpendicular from the first overlapping plate 426 is a first joint-termination leg 424, which extends beyond the plane of the top of the mounting leg 434 and beyond the lath 416 when assembled. Extending perpendicular to the first joint-termination leg 424 is a first overhanging leg 422. The first expansion joint 411 can be placed at various distances from a second expansion joint 413 and the second expansion joint 413 is capable of sliding over the first expansion joint 411. The second expansion joint 413 has a bottom mounting plate 410, which at its base forms a bottom mounting plane. One on end of the bottom mounting plate 410 is a flashing 408 that rises and then forms the second expansion joint overlapping plate 406. The flashing 408 provides a pre-tensioned bend in the metal to allow for a tighter seal against the first expansion joint 411 when a screw 418 secures the second expansion joint 413 to a wall or framing through a moisture barrier 420. The second expansion joint 413 has a second overlapping plate 406, which is substantially parallel to the first expansion joint overlapping plate 426, such that the second expansion joint overlapping plate 406 lays on top of the first expansion joint overlapping plate 426 when assembled together to form the two-piece expansion joint 400, 440. Extending substantially perpendicular from the second expansion joint overlapping plate 406 is a second expansion joint termination leg 404. Extending substantially perpendicular from the second expansion joint termination leg 404 is a second overhanging leg 402. The first overhanging leg 422 and second overhanging leg 402 are substantially in the same plane as each other. The space between the first termination leg 424 and second termination leg 404 can expand, or contract when the temperature changes. The second overlapping plate 406 can slide back and forth over the first overlapping plate 426 when the temperature changes. The second expansion joint 410 has an top mounting plate 412 on of its bottom mounting plate 12. Extending perpendicular from the top mounting plate 412 is a second mounting leg 432, where lath 416 is attached through a hole on the mounting leg 414. Both the first expansion joint 411 and second expansion joint 413 secured to a wall or framing by penetrating the top and bottom mounting plates 430, 428, 412, 413 of each expansion joint 411, 410 to a wall of framing via a screw 418 or other mounting device. The first expansion joint 411 and the second expansion joint 413 can have the added strength of a hemmed mounting leg 122 as shown in FIG. 4*b*. Additionally, other embodiments featuring a two piece expansion joint 400, 440 can have the flexible water resistive barrier 6 as shown in FIG. 1*a* or 166 in FIG. 4*b*, to further prevent seepage of water from plaster through holes created through the moisture barrier 420 by the screws 418 that penetrate the moisture barrier 420 that hold two-piece expansion joint 400, 440 to the wall or framing. The height of the first expansion joint 411 and the second expansion joint 413 from the base of each expansion joint 411, 413 to the top of each mounting leg 434, 414 is 0.365 inches or less so that the lath 416 can be consistently laid at ⅜ of an inch away from the framing.

Figure 14A:
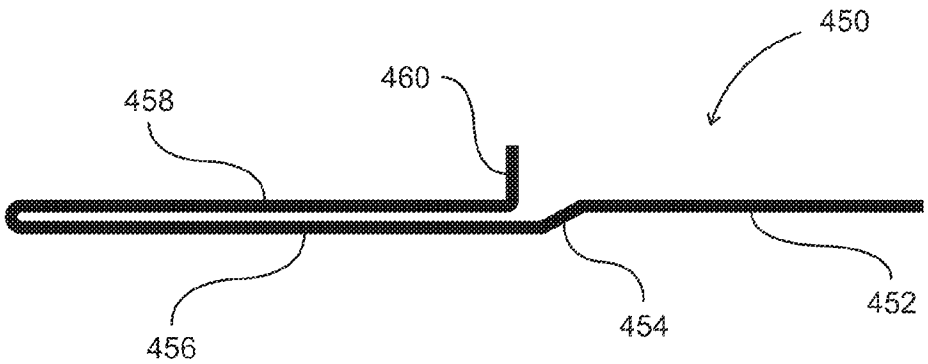
FIG. 14*a* is a side elevation view of a window furring strip.
Figure 14B:
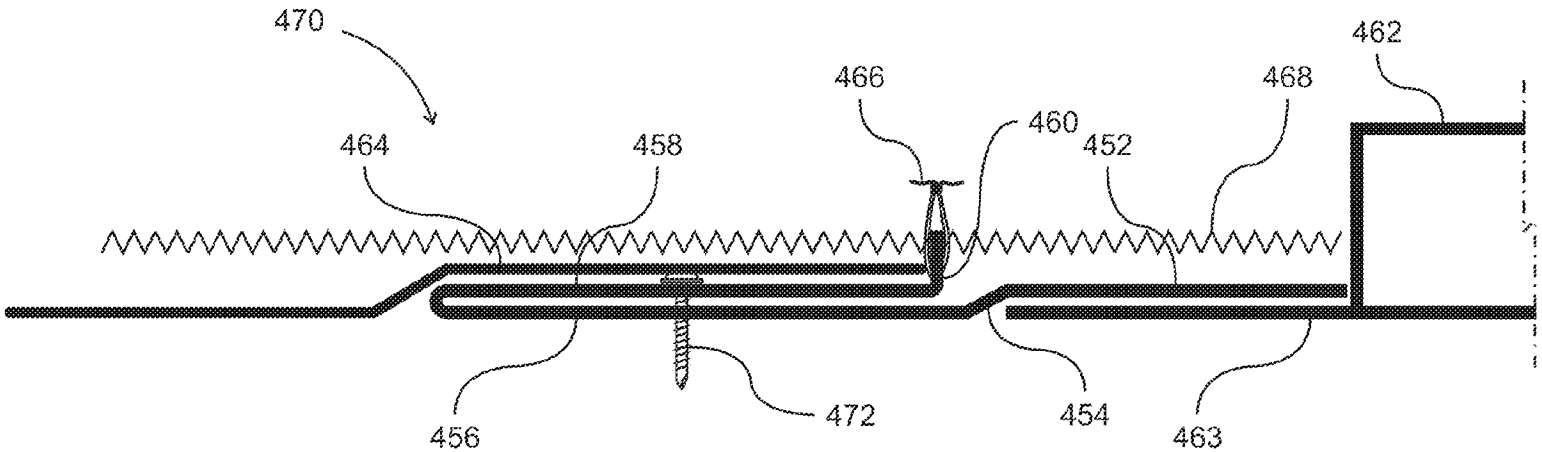
FIG. 14*b* is a side elevation view of a window furring strip assembled with a lath and moisture barrier.

FIG. 14*a* and FIG. 14*b* depict a window lath furring strip 450 and an assembled window lath furring strip 470 assembled with a lath 468, wire tie 466, moisture barrier 464, over a window flange 463 of a window 462. The lath-furring strip 450, 470 has a bottom mounting plate 456 and an integral top mounting plate 458. A bottom mounting plane is formed at the base of the bottom mounting plate 456. Extending from the fop mounting plate 458 is a mounting leg 460 where lath 468 attaches to the mounting leg 460 via a wire tie 466. Extending from the bottom mounting plate 456, beyond the mounting leg 460 is a flare 454 designed to have a pre-tensioned shape in the metal to allow the furring, strip 450 to seal tightly against the window flange 463 when a screw 472 penetrates through the top mounting plate 458 and the bottom mounting plate 456 into a wall or framing. This creates a tight seal between the lath furring strip 450 and the window flange 463, which prevents moisture that may gather around the window 462 from seeping from the plaster on the lath 668 into the wall. A moisture barrier 464 is installed on top of the head of the screw 474, on the top mounting plate 458 to eliminate any moisture barrier penetration from plaster to the wall created by the penetration of the screw 472 into the top mounting plate 458, and bottom mounting plate 456 into the wall. The furring strip 450, 470 can have the added strength of a hemmed mounting leg 122 as shown in FIG. 4*b*. Additionally, other embodiments featuring a window furring strip 400 can have the flexible water resistive barrier 6 as shown in FIG. 1*a*, or 166 in FIG. 4*b*, to further prevent seepage of water from plaster through holes created by a screw 472. The height of the window, furring strip 450, 470 from the bottom mounting plate 456 to the plane formed by the top of the mounting leg 460 is 0.365 inches or less so that the lath 468 can be consistently laid at ⅜ of an inch away from the framing.

The invention has been described in terms of preferred embodiments thereof, but is more broadly applicable as will be understood by those skilled in the art. The scope of the invention is only limited by the scope of the following claims and equivalents thereof.

I claim:

1. A two-piece expansion joint integrated with a lath furring strip, comprising:

a first expansion joint member and a second expansion joint member overlapping said first expansion joint;

Said first expansion joint member comprising, a first bottom mounting plate having a base that forms a first bottom mounting plane, a first top mounting plate substantially parallel to said bottom mount plate, a first mounting leg for securing lath, a first overlapping plate substantially parallel to said first bottom mounting plate, a first vertical termination leg, and a first overhanging flange extending substantially perpendicular to said first vertical termination leg;

Said second expansion joint member comprising a second bottom mounting plate having a base that forms a second bottom mounting plane, a second a top mounting plate, a second mounting leg for securing lath, a flashing extending angularly from said second bottom mounting plate to form a second overlapping plate, a second vertical termination leg, and a second overhanging flange substantially perpendicular from said second vertical termination leg;

wherein said first mounting leg and said second mounting leg have at least one hole for securing lath; and, wherein the distance from the first bottom mounting plane to the top of said first mounting leg, and the distance from the second bottom mounting plane to the top of said second mounting leg does not exceed 0.365 inches;

whereby said first expansion joint and said second expansion joint can be installed such that said flare allows for a slideable seal between said first expansion joint and said second expansion joint;

whereby said flashing and said second overlapping plate create a pre-tensioned bend in said second expansion joint member to allow for a tight seal when said first and second expansion joint members are fastened to a framing member, thereby providing superior moisture intrusion protection; and, whereby said two-piece expansion joint can be installed to provide a variable size to an expansion joint width depending on the width specified to in an architectural plan.

2. The furring strip of claim 1 further comprising a flexible elastic water resistive barrier on said first and said second bottom plates.

3. The furring strip of claim 2, wherein said flexible elastic water resistive barrier is greater than or equal to 1/16 of an inch.

4. The furring strip of claim 2, wherein said flexible elastic water resistive barrier is greater than or equal to 1/32 of an inch.

5. The furring strip of claim 1 wherein said first and said second mounting legs are a first and a second hemmed mounting leg.

* * * * *